US005652942A

United States Patent [19]

Iseki et al.

[11] Patent Number: 5,652,942

[45] Date of Patent: Jul. 29, 1997

[54] IMAGE FORMING APPARATUS

[75] Inventors: Shuji Iseki; Norio Hokari; Junichirou Sameshima; Ryoichi Tsuruoka; Yoshiaki Watanabe; Mikio Kobayashi; Yukio Hayashi, all of Ebina, Japan

[73] Assignee: Fuji Xerox Co., Ltd., Tokyo, Japan

[21] Appl. No.: 630,481

[22] Filed: Apr. 11, 1996

[30] Foreign Application Priority Data

Apr. 14, 1995 [JP] Japan ..... 7-089046

[51] Int. Cl.[6] ..... G03G 15/00

[52] U.S. Cl. ..... 399/21; 399/299

[58] Field of Search ..... 355/204, 205, 355/207, 208, 272, 308, 309, 316, 317, 326 R, 327; 399/21, 22, 299, 300, 303, 388

[56] References Cited

U.S. PATENT DOCUMENTS

| | | |
|---|---|---|
| 4,937,622 | 6/1990 | Makiura . |
| 5,010,363 | 4/1991 | Higashio et al. . |
| 5,328,168 | 7/1994 | Fox . |
| 5,440,382 | 8/1995 | Suga . |
| 5,459,553 | 10/1995 | Kim . |
| 5,485,247 | 1/1996 | Morishita et al. . |
| 5,502,545 | 3/1996 | Tsuruoka . |

FOREIGN PATENT DOCUMENTS 1-109383 4/1989 Japan .

*Primary Examiner*—Sandra L. Brase
*Attorney, Agent, or Firm*—Oliff & Berridge

[57] ABSTRACT

An image forming apparatus comprising: an image recording unit including image carriers on which toner images are respectively formed, a paper carrier which conveys paper fed to a paper drawing-in position while drawing therein, and transfer units which transfer respective toner images on the image carriers onto the paper on the paper carrier at predetermined image transfer positions of the image carriers; paper jam detecting means for detecting a paper jam occurring when the paper drawn in by the paper carrier adheres to the surfaces of the image carriers; conveyor rollers disposed in a paper feeding unit which feeds the paper to a paper drawing-in position in the image recording unit at a predetermined timing; an inlet chute including an upper paper guide and a lower paper guide for guiding the paper fed from the conveyor rollers toward the paper drawing-in position; conveyor roller rotation control means which suspend the rotation of the conveyor rollers until the paper stretched between the image recording unit and the conveyor rollers of the paper feeding unit has passed through the conveyor rollers, if a paper jam arises while the paper is stretched between them; reverse rotation suspending means which rotates the paper carrier in a reverse direction if a paper jam arises and then suspends the rotation; and a removable member configured so as to be detachable from, and attachable to, a main unit of the image forming apparatus.

10 Claims, 14 Drawing Sheets

IMAGE FORMING APPARATUS

BACKGROUND OF THE INVENTION

The present invention relates to an image forming apparatus comprising an image recording unit for electrostatistically transferring a toner image formed on the surface of an image carrier (a photosensitive substance) to paper which is carried, while being drawn in, by a belt-like or a drum-like paper carrier, and a paper feeding unit which feeds the paper to the image recording unit. More particularly, the present invention relates to an image forming apparatus designed to facilitate correction of paper jams.

In a conventional image forming apparatus, paper drawn in by a paper carrier is sometimes drawn against an image carrier at an image transfer position of the paper carrier. In such a case, the paper drawn by the image carrier is drawn into a cleaner unit disposed along the surface of the image carrier downstream with respect to the image transfer position, thereby causing a paper jam (a paper-on-photoreceptor jam which will be hereinafter referred to as a POP jam). To facilitate the correction of such a paper jam, a technique as disclosed in the Unexamined Japanese Patent Application Publication. No. Hei. 1-109383 is already known. This patent publication discloses a technique which rotates a transfer drum in a reverse direction when a paper jam is detected by paper jam detecting means disposed in a separating pawl unit.

However, according to this technique, if a part of the paper still remains upstream with respect to transfer rolls (in many cases, a resi-roll is used for the transfer rolls) of the main unit of the image forming apparatus when the POP jam arises, that part of the paper remains sandwiched between the resi-rolls even when the transfer drum is rotated in a reverse direction. If a drawer unit (a removable member) is removed from the main unit of the image forming apparatus together with the paper carrier while the part of the paper sandwiched between the resi-rollers, the paper becomes torn. A small piece of the paper thus remains between the resi-rolls, which makes it difficult to remove the remaining piece of paper.

Further, according to the previously mentioned technique, if the POP jam occurs which trailing end of the paper has passed an inlet chute, the rotation of the paper carrier in a reverse direction in this state causes the trailing end of the paper to burrow its way under the inlet chute. If the drawer unit including the paper carrier is removed from the main unit of the image forming apparatus, the trailing end of the paper is caught by the main unit of the image forming apparatus outside the drawer unit. In this case, the trailing end of the paper has an appearance as if it has been trimmed with a guillotine. Eventually, a small piece of paper remains in the main unit of the image forming apparatus, which makes it difficult to remove the remaining piece of paper.

For these reasons, it is difficult to reliably remove jamming paper from the image forming apparatus with the conventional technique only by means of a simple operation such as the removal of a detachable unit from the apparatus.

If a POP jam arises while paper is stretched between the paper carrier and the resi-rollers, if the paper is conveyed into the inlet chute by letting the trailing end of the paper pass through the resi-rollers, the paper will become concertinaed within the inlet chute. To make it possible to contain such concertinaed paper in the inlet chute, an interval between an upper paper guide and a lower paper guide of the inlet chute should be previously set to a sufficiently large size, or should be made variable. In either case, the height of the concertinaed paper within the inlet chute becomes increased.

When the removable drawer unit is removed from the main unit of the image forming apparatus in order to correct the paper jam, an attempt to rake the concertinaed paper out of the inlet chute results in the paper being caught by a fixed member, such as a frame, of the main unit of the image forming apparatus. As a result, the paper becomes torn. It is not easy to remove a small piece of paper thus remaining in the main unit of the image forming apparatus.

In a system which rotates the image carrier and the paper carrier in a reverse direction when the POP jam occurs, the following problems are encountered if a cleaner of the paper carrier is provided with a wiper blade.

Specifically, as a result of rotation of the paper holder in a reverse direction, the leading edge of the wiper blade that is in contact with the paper carrier curls up. If the leading edge of the wiper blade is left in the curled up state for a long period of time, the wiper blade becomes deformed or is deteriorated. As a consequence, the cleaning capability of the image forming apparatus deteriorates very quickly. For this reason, it is desirable to correct the curled up leading edge of the wiper blade in a shorter period of time.

If the POP jam was not detected, or was detected late, the paper is pulled into the cleaner unit of the image carrier, which makes it difficult to correct the POP jam. According to a known conventional method of detecting the POP jam, a paper sensor detects paper coiled around the image carrier. However, this method has such a problem that the circumferential length of the image carrier becomes longer because the paper sensor occupies a part of the space around the image carrier.

For this reason, with regard to an image forming apparatus in which a toner image having a plurality of colors is transferred onto paper, it is proposed that a light reflecting paper sensor is not disposed around the image carrier but along the surface of a belt or drum-like paper carrier.

The light reflecting paper sensor is arranged so as to detect light reflected from white paper, and hence the sensor receives light reflected from an image on one side of the paper when both faces of the paper are copied. If a dark image is formed on one side of the paper, it becomes impossible to detect the paper.

SUMMARY OF THE INVENTION

The present invention is conceived in view of the foregoing problems in the prior art, and the primary object of the present invention is to make it possible to easily remove all of the jammed paper from an image forming apparatus by removing a removable member (a drawer unit) from the main unit of the image forming apparatus.

A second object of the present invention is to reduce the time during which the leading edge of a wiper blade of a cleaner of a paper carrier remains in a curled state when an image carrier and the paper carrier are reversely rotated to correct a POP (paper-on-photoreceptor) jam.

A third object of the present invention is to ensure the detection of a POP jam.

The present invention conceived to solve the above described problems will now be described. To provide a clear correspondence between the elements of the present invention and elements of preferred embodiments which will be described later, reference numerals used to designate the elements in the embodiments are also used for the corresponding elements in the present invention, by they are parenthesized.

Several reference numerals of the embodiments are connected together by a + symbol in one bracket. These numerals parenthesized in one bracket designate that several elements of the embodiments in combination correspond to a single element of the present invention. The description of the present invention referring to the reference numerals of the preferred embodiments is intended to provide a better understanding of the present invention. Hence, it should not be construed that the present invention is limited to the illustrative embodiments which will be described later.

To these ends, according to a first aspect of the present invention, there is provided an image forming apparatus (U) comprising:

an image recording unit (B+Uy, Um, Uc, and Uk) including image carriers (Dy, Dm, Dc, and Dk) on which toner images are respectively formed, a paper carrier (26) which conveys paper (P) fed to a paper drawing-in position (P1) while drawing it in, and transfer units (33) which transfer respective toner images on the image carriers (Dy, Dm, Dc, and Dk) onto the paper (P) on the paper carrier (26) at predetermined image transfer positions of the image carriers;

POP jam detecting means (J) for detecting a POP jam occurring when the paper (P) drawn in by the paper carrier (26) adheres to the surfaces of the image carriers (Dy, Dm, Dc, and Dk);

resi-rollers (91) disposed in a paper feeding unit which feeds the paper (P) to a paper drawing-in position (P1) in the image recording unit (B+Uy, Um, Uc, and Uk) at a predetermined timing;

an inlet chute (94) including an upper paper guide (96) and a lower paper guide (95) for guiding the paper (P) fed from the resi-rollers (91) toward the paper drawing-in position (P1);

resi-roller rotation control means (M+113) which suspend the rotation of the resi-rollers (91) until the paper (P) stretched between the image recording unit (B+Uy, Um, Uc, and Uk) and the resi-rollers (91) of the paper feeding unit has passed through the resi-rollers (91), if a POP jam arises while the paper (P) is stretched between them;

reverse rotation suspending means (M+114) which rotates the paper carrier (26) in a reverse direction if a POP jam arises and then suspends the rotation; and a removable member (C) configured so as to be detachable from, and attachable to, a main unit (U1) of the image forming apparatus.

According to a second aspect of the present invention, the image forming apparatus (U) should preferably be provided with a paper raking member (81) disposed in the removable member (C). When the removable member (C) is removed from the inside of the main unit (U1) of the image forming apparatus, the paper raking member (81) rakes out the paper (P) contained in the inlet chute (94) disposed downstream with respect to the resi-rollers (91).

According to a third aspect of the present invention, the image forming apparatus (U) having the configuration as defined in the second aspect should preferably be provided with the plurality of image carriers (Dy, Dm, Dc, and Dk) on which toner images having different colors are respectively formed, the paper carrier (26) made up of a belt (26) for conveying paper which is rotatively supported by a plurality of rollers (25*a*, 25*b*, 25*c*, and 25*d*), a fixing unit (62) for fixing the toner image transferred on the paper, the removable member (C) made up of the belt (26), the transfer unit (33), and the fixing unit (62), and the resi-rollers (91) and the inlet chute (94) supported by the main unit (U1) of the image forming apparatus.

According to a fourth aspect of the present invention, the image forming apparatus (U) having the configuration as defined in the first aspect should preferably be provided with the upper paper guide (96) of the inlet chute (94) that is supported by the main unit (U1) of the image forming apparatus via a developing unit (17) of the image carrier (Dy) disposed upstream in the direction in which the paper is conveyed by the belt (26).

According to a fifth aspect of the present invention, the image forming apparatus (U) having any one of the above-described configurations should preferably be provided with a paper height regulating member (97) which prevents the paper (P) from being caught by constituent elements of the main unit (U1) of the image forming apparatus by regulating the height of the paper (P) when the paper (P) is raked out of the inlet chute (94).

According to a sixth aspect of the present invention, the image forming apparatus (U) having any one of the above-described configurations should preferably be provided with a paper guide (68) which is disposed in the removable member (C) so as to be able to receive the paper (P) conveyed in a reverse direction as a result of reversely rotating the paper carrier (26).

According to a seventh aspect of the present invention, there is provided an image forming apparatus (U) comprising an image recording unit (B+Uy, Um, Uc, and Uk) including image carriers (Dy, Dm, Dc, and Dk) on which toner images are respectively formed, a paper carrier (26) which conveys paper (P) fed to a paper drawing-in position (P1) while drawing it in, and transfer units (33) which transfer respective toner images on the image carriers (Dy, Dm, Dc, and Dk) to the paper (P) on the paper carrier (26) at predetermined transfer positions of the image carriers;

POP jam detecting means (J) for detecting a POP jam occurring when the paper (P) drawn in by the paper carrier (26) adheres to the surfaces of the image carriers (Dy, Dm, Dc, and Dk);

resi-rollers (91) disposed in a paper feeding unit for feeding the paper (P) to a paper drawing-in position (P1) in the image recording unit (B+Uy, Um, Uc, and Uk) at a predetermined timing;

an inlet chute (94) including an upper paper guide (96) and a lower paper guide (95) for guiding the paper (P) fed from the resi-rollers (91) toward the paper drawing-in position (P1);

resi-roller rotation control means (M+113) which suspends the rotation of the resi-rollers (91) until the paper (P) stretched between the image recording unit (B+Uy, Um, Uc, and Uk) and the resi-rollers (91) of the paper feeding unit has passed through the resi-rollers (91), if the POP jam arises while the paper (P) is stretched between the image recording unit and the resi-rollers;

reverse rotation suspending means (M+114) which rotates the paper carrier (26) in a reverse direction if the POP jam arises, and then suspends the rotation; and a cleaner (18; 63) having a wiper blade (67) for cleaning the paper carrier (26).

According to an eighth aspect of the present invention, the image forming apparatus (U) having the configuration as defined in the seventh aspect should preferably be provided with the image recording unit (B+Uy, Um, Uc, and Uk) including the image carriers (Dy, Dm, Dc, and Dk) on which toner images are respectively formed, a transparent paper carrier (26) for conveying the paper (P) fed to the paper drawing-in position (P1) while drawing the paper in, and the transfer unit (33) which transfers the toner images on the image carriers (Dy, Dm, Dc, and Dk) to the paper (P) on the paper carrier (26) at predetermined transfer positions of the image carriers, and the POP jam detecting means (J) which is disposed at a position slightly downstream with respect to the transfer position of the paper carrier (26), and which detects a POP jam using an amount of light received by a paper sensor (S) designed to receive light reflected from a sheet of paper which enters the paper sensor after having traversed the surface of the paper carrier (26).

The operation of the image forming apparatus having the construction as defined in the description of the first aspect of the present invention will now be described.

In the image forming apparatus (U) according to the first aspect of the present invention, the resi-rollers (91) disposed in the paper feed unit feed the paper (P) to the paper drawing-in position (P1) of the image recording unit (B+Uy, Um, Uc, and Uk) at a predetermined timing. The paper (P) fed from the resi-rollers (91) is guided to the paper drawing-in position (P1) by the upper paper guide (96) and the lower paper guide (95).

The paper carrier (26) of the image recording unit (B +Uy, Um, Uc, and Uk) draws the paper (P) fed from the inlet chute (94) to the paper drawing-in position (P1), and transfers it to the respective image transfer positions of the image carriers. The transfer unit (33) transfers the toner images formed on the respective image carriers (Dy, Dm, Dc, and Dk) to the paper (P) on the paper carrier (26) at transfer positions of the image carriers.

The POP jam detecting means (J) detects a POP jam caused as a result of the paper (P) on the paper carrier (26) being drawn against any of the surfaces of the image carriers (Dy, Dm, Dc, and Dk).

The resi-roller rotation control means (M+113) suspends the rotation of the resi-rollers (91) until the paper (P) stretched between the image recording unit (B+Uy, Um, Uc, and Uk) and the resi-rollers (91) of the paper feed unit has passed through the resi-rollers (91), if the POP jam arises while the paper (P) is stretched between image recording unit and the resi-rollers.

The reverse rotation suspending means (M+114) rotates the paper carrier (26) in a reverse direction if the POP jam arises and then suspends the rotation.

The removable member (C) is removed from the main unit (U1) of the image forming apparatus in order to remove jammed paper if a POP jam arises. The removable member (C) may be constructed so that the paper carrier (26), the transfer unit (33), the resi-rollers (91), and the inlet chute (94) can be detached from, or attached to, the image forming apparatus in an integrated manner. Alternatively, it may be constructed in such a way that the paper carrier (26) and the transfer unit (33) can be detached from, or attached to, the image forming apparatus in an integrated fashion while the resi-rollers (91) and the inlet chute (94) are supported by the main unit (U1) of the image forming apparatus. Further, it may be constructed so that the paper carrier (26), the transfer unit (33), the fixing unit (62), and other units can be detached from, or attached to, the main unit of the image forming apparatus in an integrated fashion.

Provided that the removable member (C) is constructed in such a way that the paper carrier (26) and the transfer unit (33) can be detached from, or attached to, the image forming apparatus while the resi-rollers (91) and the inlet chute (94) are supported by the main unit (U1) of the image forming apparatus, the paper (P) contained in the inlet chute (94) disposed downstream from the resi-rollers (91) is pulled out from the inside of the main unit (U1) of the image forming apparatus together with the removal of the removable member (C).

By virtue of the above mentioned construction of the image forming apparatus, in the event that a POP jam arises, it becomes possible to easily remove the paper (P) stretched between the resi-rollers (91) of the paper feed unit and the image recording unit (B+Uy, Um, Uc, and Uk) by detaching the removable member (C) from the main unit.

The operation of the image forming apparatus having the construction as defined in the description of the second aspect of the present invention is as follows:

The paper raking member (81) disposed in the removable member (C) rakes out the paper (P) contained in the inlet chute (94) disposed downstream with respect to the resi-rollers (91). Therefore, it is possible to remove the paper (P) stretched between the resi-rollers (91) and the image recording unit (B+Uy, Um, Uc, and Uk) in a more reliable way.

The operation of the image forming apparatus having the construction as defined in the description of the third aspect of the present invention is as follows:

In the image forming apparatus (U) having such a construction as defined in the third aspect, different color toner images are formed on the respective surfaces of the image carriers (Dy, Dm, Dc, and Dk). The paper conveyor belt (26) constituting the paper carrier (26) is rotatively supported by a plurality of rollers (25*a*, 25*b*, 25*c*, and 25*d*). The belt (26) conveys the paper to the respective transfer positions where the toner images of the image carriers (Dy, Dm, Dc, and Dk) are respectively transferred to the paper. The toner image thus transferred onto the paper is fixed by the fixing unit (62).

To remove the paper jammed as a result of the occurrence of a POP jam, the removable member (C) is removed from the main unit (U1) of the image forming apparatus. At this time, the resi-rollers (91) and the inlet chute (94) supported by the main unit (U1) of the image forming apparatus remain within the main unit (U1) of the image forming apparatus.

When the removable member made up of the belt (26), the transfer unit, and the fixing unit (62) is removed from the main unit of the image forming apparatus, the paper raking member (81) rakes out the paper (P) contained in the inlet chute (94) disposed downstream with respect to the resi-rollers (91).

Eventually, if a POP jam arises, it is possible to easily remove the paper (P) stretched between the resi-rollers (91) and the image recording unit (B+Uy, Um, Uc, and Uk) by detaching the removable member (C).

In this way, by virtue of the construction that causes the resi-rollers (91) and the inlet chute (94) to remain in the main unit (U1) of the image forming apparatus, it is possible to reduce the size of the removable member (C).

The operation of the image forming apparatus (U) having the construction as defined in the description of the fourth aspect of the present invention is as follows:

The developing unit (17) of the image carrier (Dy) disposed upstream in the direction in which the belt (26) conveys the paper, is supported by the main unit (U1) of the image forming apparatus. This developing unit (17) in turn supports the upper paper guide (96) of the inlet chute (94). The developing unit (17) is disposed above so as to be close to the paper drawing-in position (P1) on the belt (26), and therefore the downstream-side end of the upper paper guide (96) in the direction of the conveyance of the paper can be easily disposed close to the paper drawing-in position (P1).

Further, it is easy for the upper paper guide (96) to pivot around the area in the vicinity of the paper drawing-in position (P1). If the upper paper guide (96) is arranged so as to be able to pivot, it becomes possible for the inlet chute (94) to receive the paper, which is fed from resi-rollers (91) into the inlet chute (94) when a POP jam arises, in a crumpled form like a concertina.

The operation of the image forming apparatus (U) having the construction as defined in the description of the fifth aspect of the present invention is as follows:

In the image forming apparatus (U), the paper height regulating member (97) regulates the height of the paper (P) when the paper (P) contained in the inlet chute (94) is raked out, thereby preventing the paper (P) from being caught by the constituent elements of the main unit (U1) of the image forming apparatus.

If a POP jam arises, it is possible to easily remove the paper (P) contained in the inlet chute (94) without tearing up the paper caught by the constituent element of the main unit (U1) of the image forming apparatus, by removing the removable member (C).

The operation of the image forming apparatus (U) having the construction as defined in the sixth aspect of the present invention is as follows:

The image forming apparatus (U) having the construction as defined in the description of the sixth aspect of the present invention is as follows:

In the image forming apparatus (U), the paper guide (68) disposed in the removable member (C) receives the paper (P) conveyed in a reverse direction as a result of rotation of the paper carrier (26) in a reverse direction. Therefore, if the paper carrier (26) is reversely rotated, the guide will not receive the paper (P) while it is being stretched between the main unit (U1) of the image forming apparatus and the removable member (C). The paper (P) received by the paper guide (68) disposed in the removable member (C) can be taken out together with the removable member (C).

The operation of the image forming apparatus (U) having the construction as defined in the seventh aspect of the present invention is as follows:

In the image forming apparatus (U), the resi-rollers (91) disposed in the paper feed unit feed the paper (P) to the paper drawing-in position of the image recording unit (B+Uy, Um, Uc, and Uk) at a predetermined timing. The paper (P) fed from the resi-rollers (91) is guided to the paper drawing-in position (P1) by means of the upper paper guide (96) and the lower paper guide (95) of the inlet chute (94).

The paper carrier (26) of the image recording unit (B+Uy, Um, Uc, and Uk) transfers the paper (P), which is fed from the inlet chute (94) to the paper drawing-in position (P1), to the respective transfer positions of the image carriers. The transfer unit (33) transfers the respective toner images formed on the image carriers (Dy, Dm, Dc, and Dk) to the paper (P) on the paper carrier (26) at the predetermined transfer positions of the image carriers. The POP jam detecting means (J) detects a POP jam caused as a result of the paper (P) being drawn against the paper carrier (26) to any of the surfaces of the image carriers (Dy, Dm, Dc, and Dk).

The resi-roller rotation control means (M+113) suspends the rotation of the resi-rollers (91) until the paper (P) stretched between the image recording unit (B+Uy, Um, Uc, and Uk) and the resi-rollers (91) of the paper feed unit has passed through the resi-rollers (91), if a POP jam arises while the paper (P) is stretched between image recording unit and the resi-rollers.

The reverse rotation suspending means (M+114) rotates the paper carrier (26) in a reverse direction if a POP jam arises, and then suspends the reverse rotation after having slightly rotated it in a forward direction.

In this case, it is possible to remove the paper (P) by means of a suitable method, such as, by drawing the removable member (C) or by opening an open/close member.

The leading edge of the wiper blade (67) of the cleaner (18; 63) which cleans the paper carrier (26) curls up when the paper carrier (26) is reversely rotated. However, the slight rotation of the paper carrier in the forward direction quickly returns the curled up leading edge of the wiper blade to a normal condition. As a result, the leading edge of the wiper blade does not come into contact with the paper carrier (26), thereby resulting in a longer life of the wiper blade (67).

The operation of the image forming apparatus (U) having the construction as defined in the eighth aspect of the present invention is as follows:

In the image forming apparatus (U), the transparent paper carrier (26) of the image recording unit (B+Uy, Um, Uc, and Uk) conveys the paper (P), which was fed to the paper drawing-in position, while drawing it in. The transfer unit (33) transfers the toner images formed on the image carriers (Dy, Dm, Dc, and Dk) to the paper (P) on the paper carrier (26) at transfer positions of the image carriers.

The paper sensors (S), which are disposed slightly downstream with respect to the transfer positions on the paper carrier (26), receive light that enters the sensors after having traversed the surface of the transparent paper carrier (26). If the paper (P) is laid on the paper carrier (26), the amount of the light that enters the sensors (S) after having traversed the surface of the transparent paper carrier (26) is decreased, which makes it possible to detect the presence or absence of the paper (P).

Therefore, the POP jam detecting means (J) detects the presence or absence of the paper (P) from the amount of the light the paper sensors (S) detect at the predetermined time, which makes it possible to prevent the occurrence of the POP jam.

BRIEF DESCRIPTION OF THE DRAWINGS

FIGS. 13A to 13C are schematic representations of the main body of the raking member, wherein FIG. 13A is a front view, FIG. 13B is a top view, and FIG. 13C is a right side view of the raking member;

FIGS. 14A to 14C are schematic representations of a guide member attached to a top surface of the main body of the paper raking member, wherein FIG. 14A is a front view, FIG. 14B is a top view, and FIG. 14C is a right side view of the main body;

DESCRIPTION OF THE PREFERRED EMBODIMENTS

Figure 1:
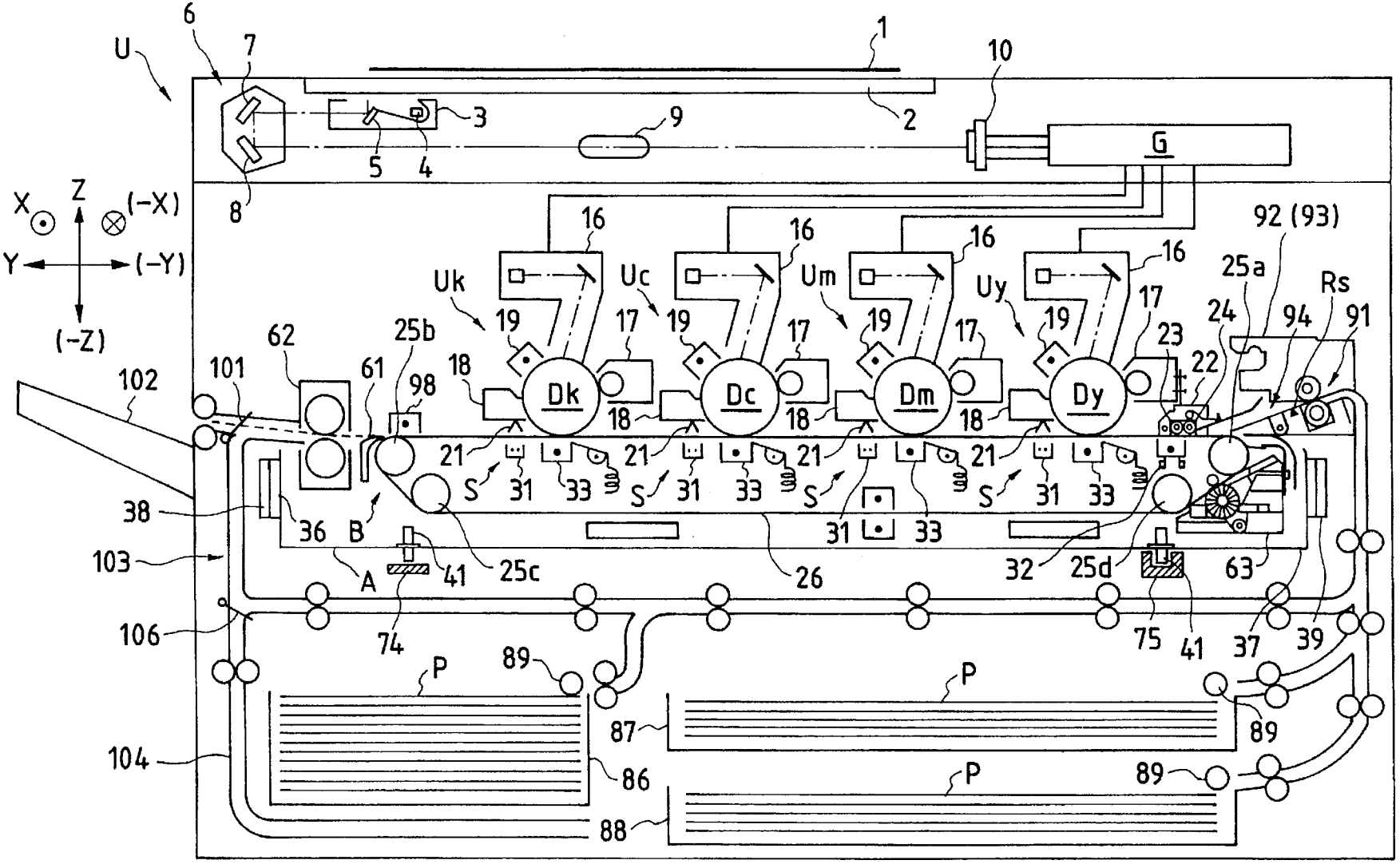
FIG. 1 is a schematic representation showing the overall construction of an image forming apparatus according to a first embodiment of the present invention.

With reference to the accompanying drawings, the preferred embodiments of the present invention will now be described. However, the present invention is not limited to the following embodiments.

For the sake of clarity of the descriptions which will be given below, the rectangular coordinates X, Y, and Z are defined respectively along the X, Y, and Z arrows which cross each other at right angles in the drawings. Further, the direction designated by the arrow X is a forward direction, the direction designated by the arrow Y is a leftward direction, and the direction designated by the arrow Z is an upward direction. In this case, the direction (a −X direction) opposite to the X direction (a forward direction) is a backward direction, the direction (a −Y direction) opposite to the Y direction (a leftward direction) is a rightward direction, and the direction (a −Z direction) opposite to the Z direction is a downward direction.

Further, the direction of the X axis comprises the forward direction (the X direction) and the backward direction (the −X direction), the direction of the Y axis comprises the leftward direction (the Y direction) and the rightward direction (the −Y direction), and the direction of the Z axis comprises the upward direction (the Z direction) and the downward direction (the −Z direction).

A symbol comprising a circled dot designates an arrow which passes through a sheet of paper from its rear to its front, and a symbol comprising a circled cross designates an arrow which passes through the sheet of paper from its front to its rear.

Figure 2:
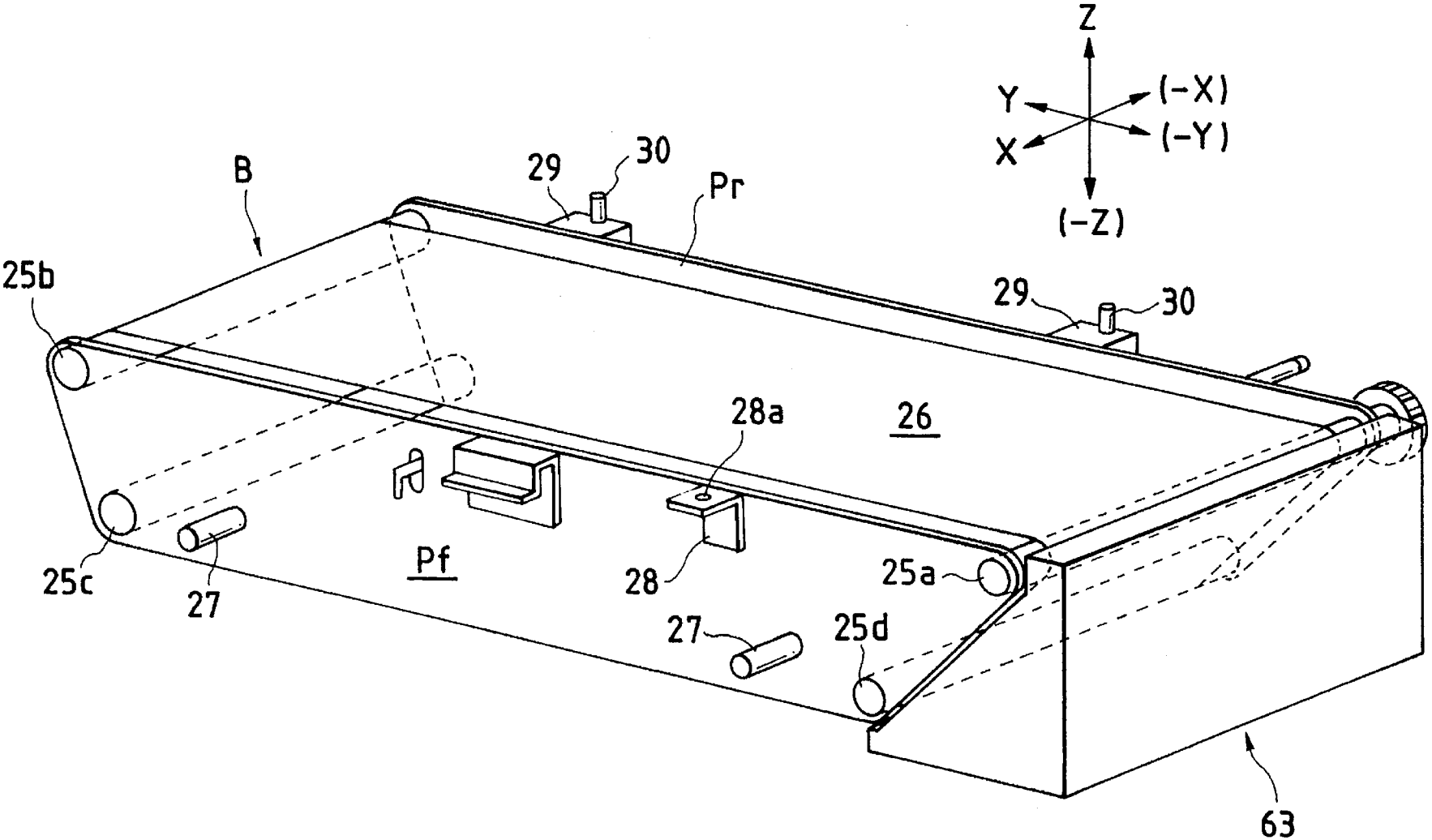
FIG. 2 is a perspective view of a belt module B of the first embodiment shown in FIG. 1.
Figure 3:
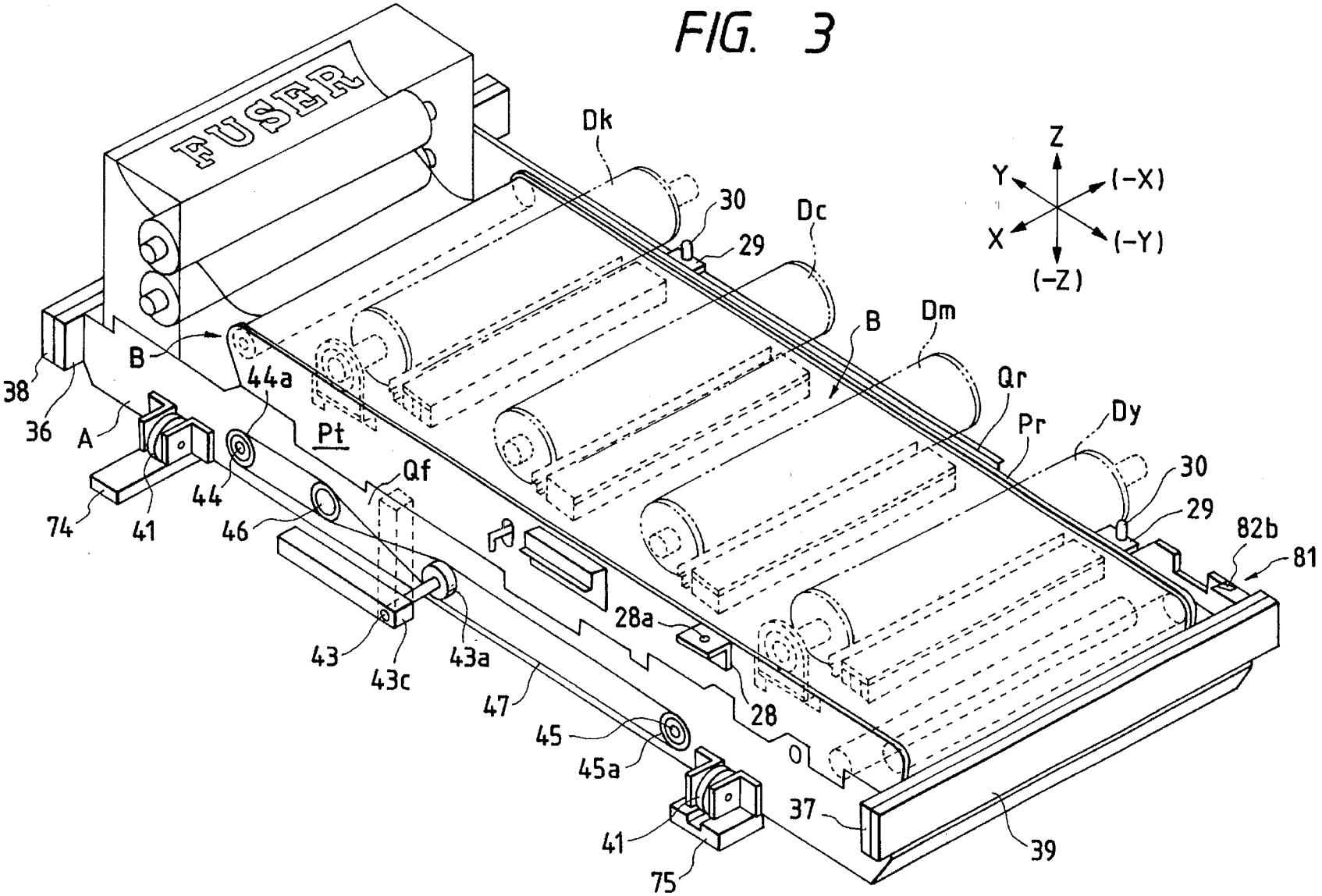
FIG. 3 is a perspective view of a removable member C, which is made up of the belt module B and a movable table A which supports the belt module B, according to the first embodiment shown in FIG. 1.
Figure 4:
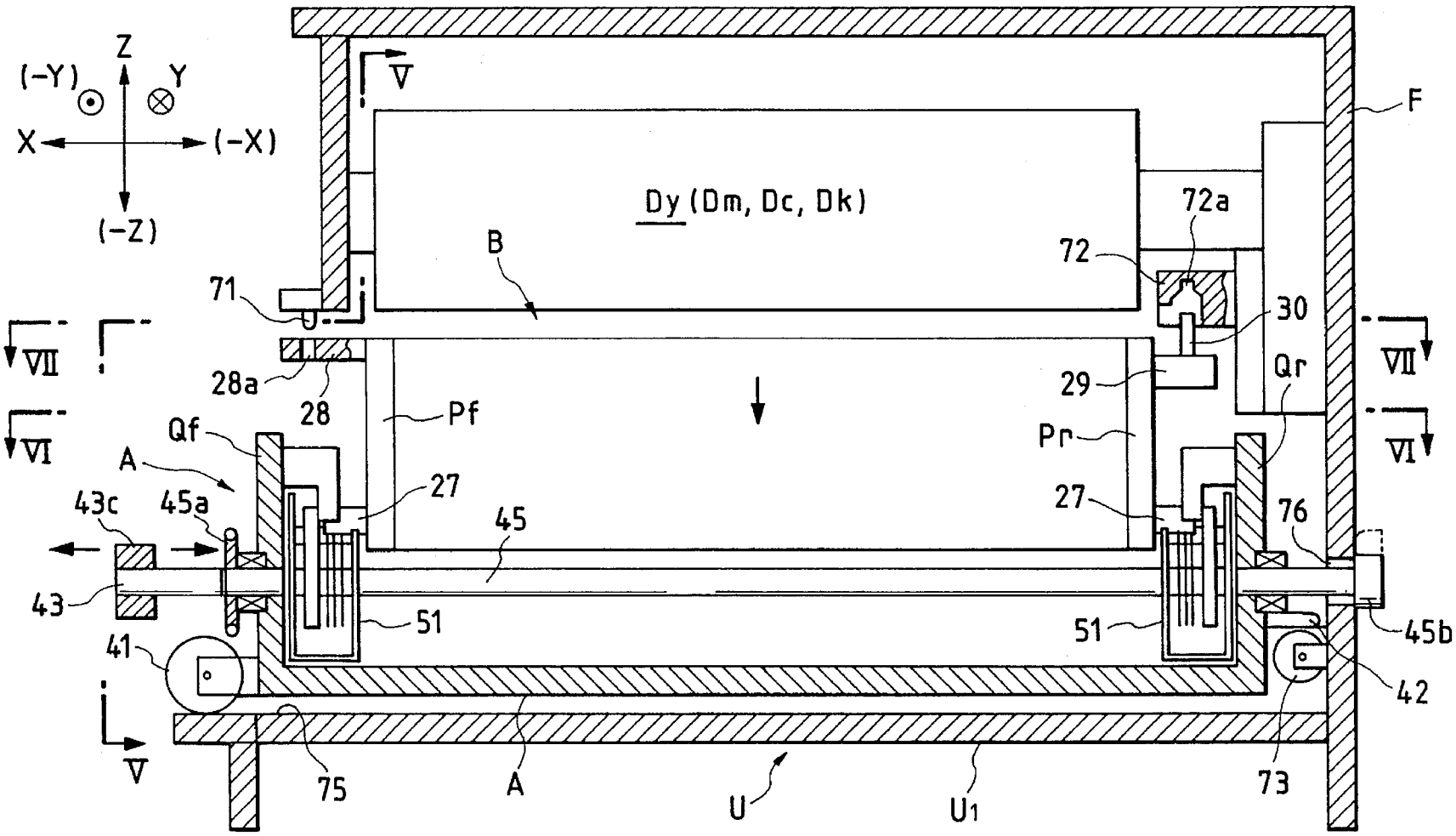
FIG. 4 is a side cross sectional view of the removable member of the first embodiment which shows the movable table A traveled to a predetermined position within the image forming apparatus.
Figure 5:
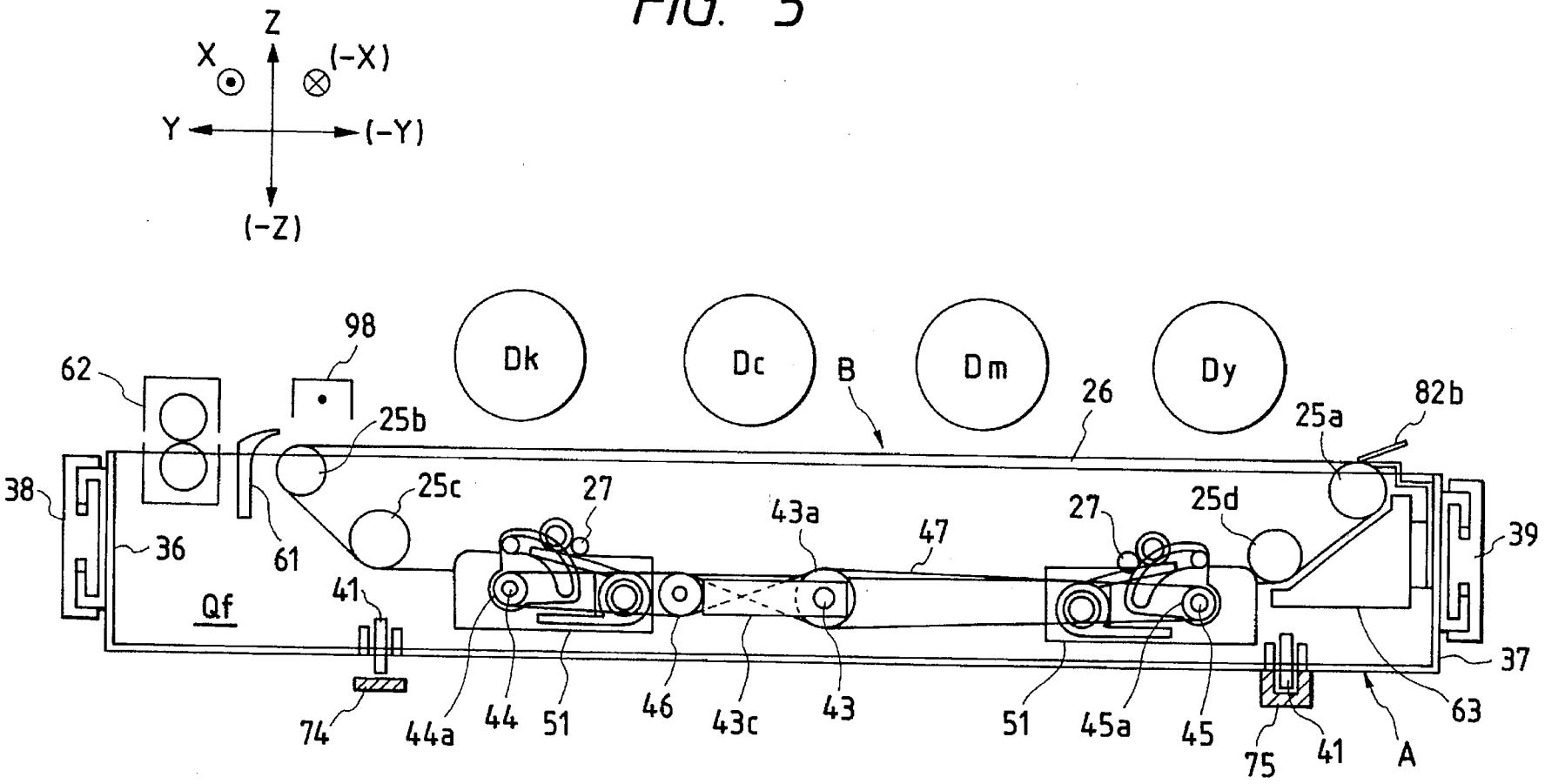
FIG. 5 is a schematic side view of the removable member shown in FIG. 4 when viewed in the direction designated by V.
Figure 6:
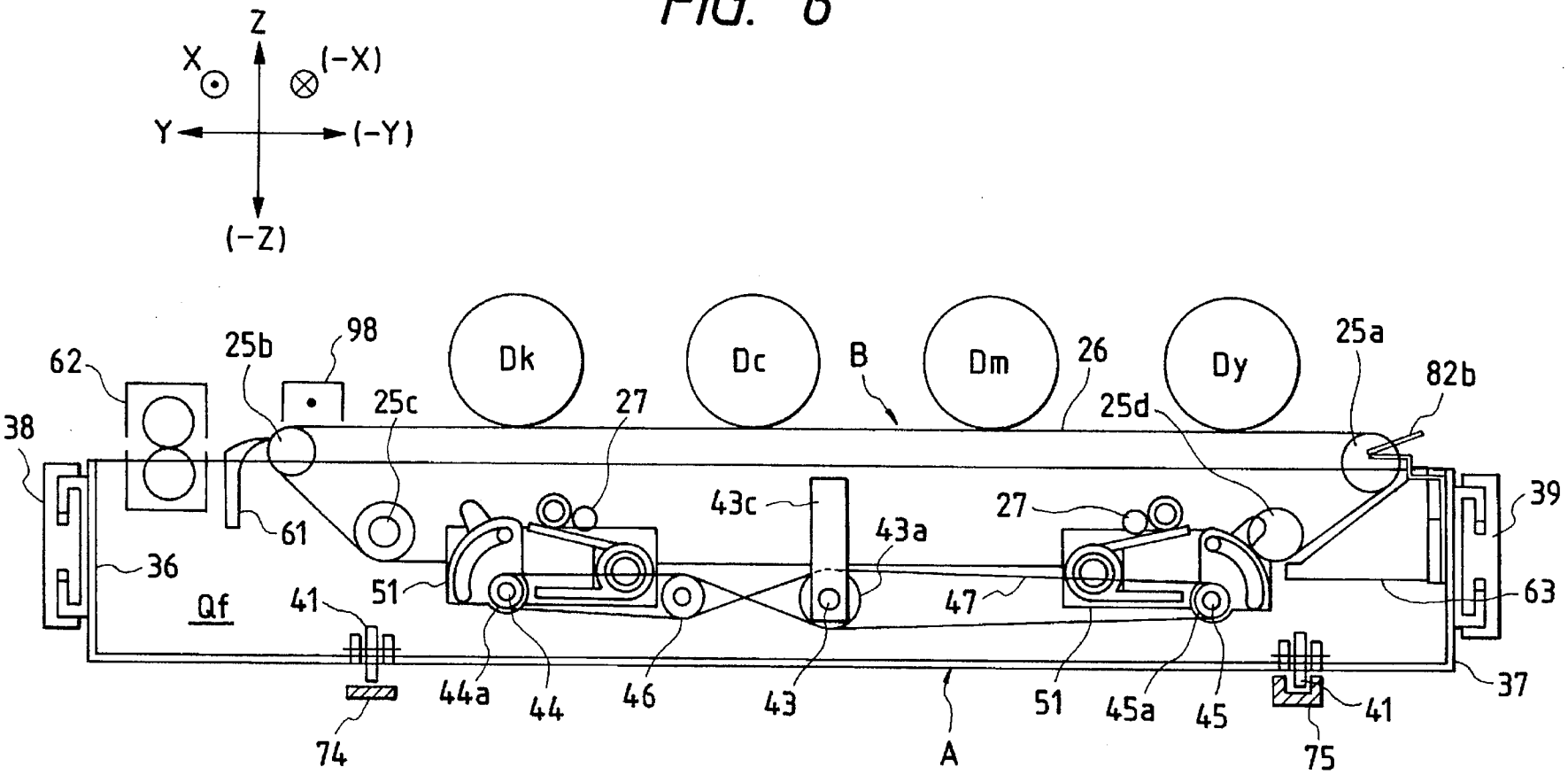
FIG. 6 is a schematic side view of the removable member which shows the belt module B raised from removable member shown in FIG. 5.
Figure 7:
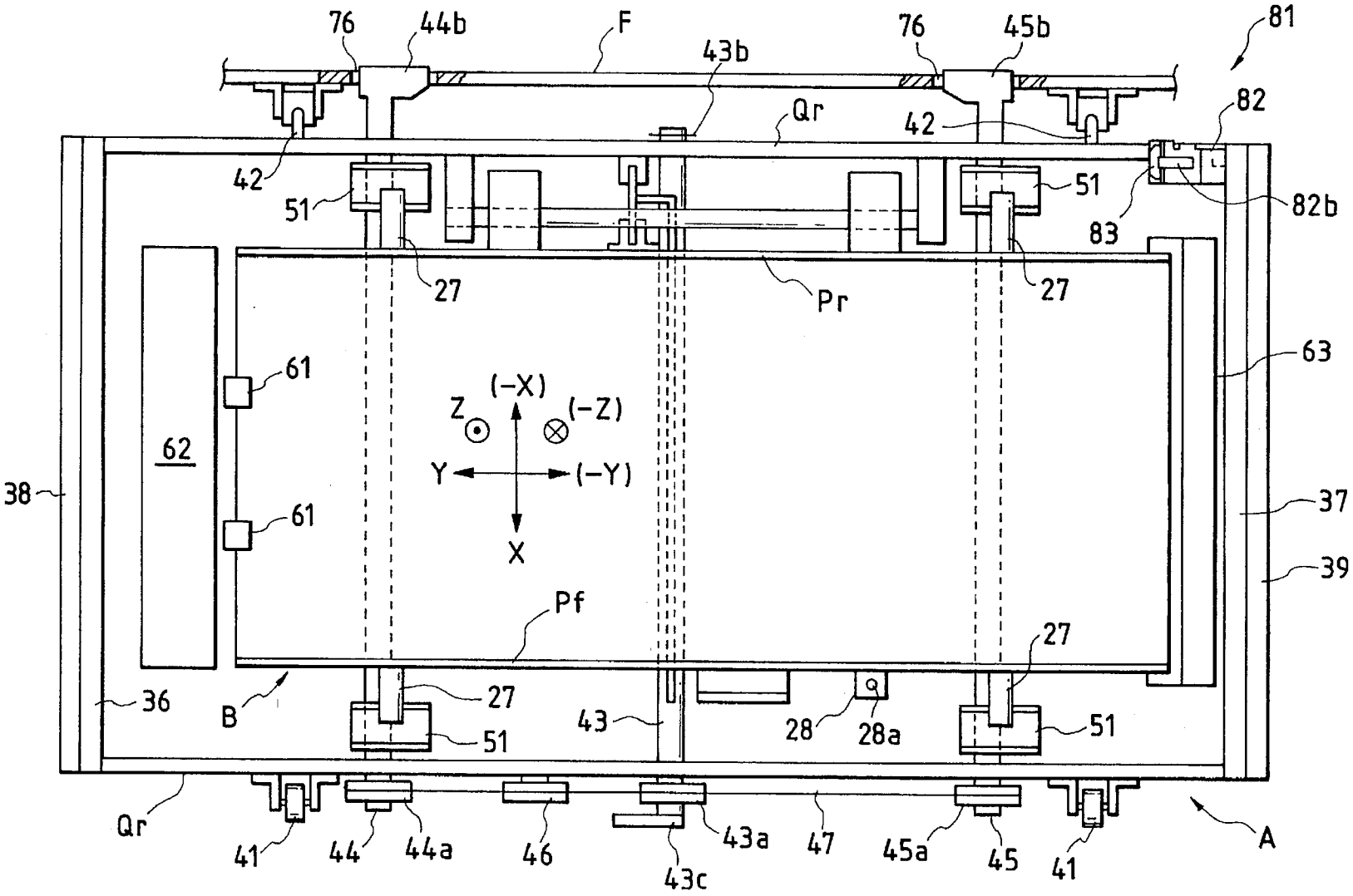
FIG. 7 is a plan view of the removable member C made up of the belt module B and the movable table A which shows the movable table A slightly drawn from a predetermined position (the position shown in FIG. 4) within the image forming apparatus.
Figure 8:
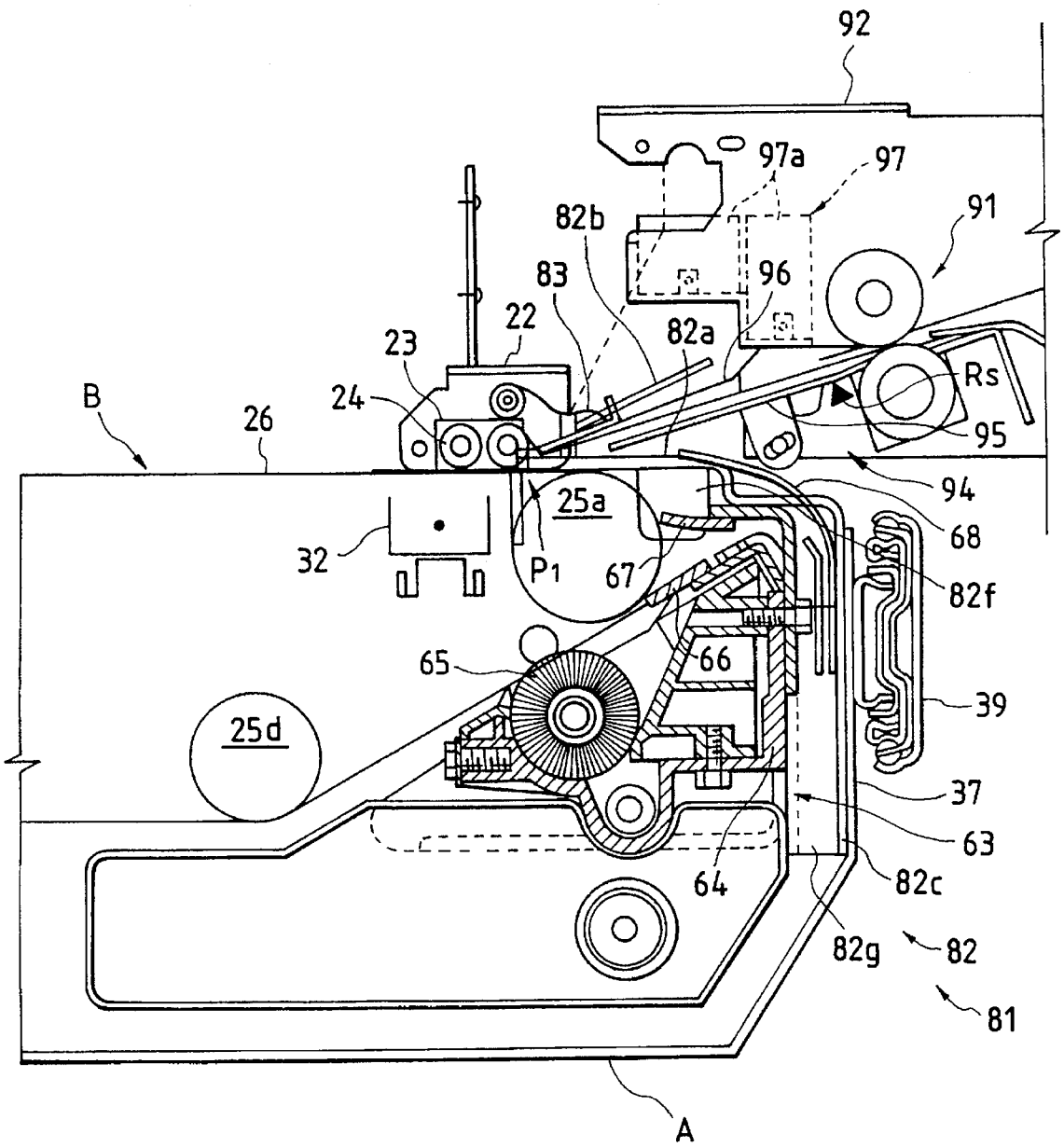
FIG. 8 is a cross sectional view of the principal element of the first embodiment, that is, a paper drawing-in unit of the belt module B, resi-rollers of a paper feed unit, and an inlet chute for guiding the paper fed from the resi-rollers.
Figure 9:
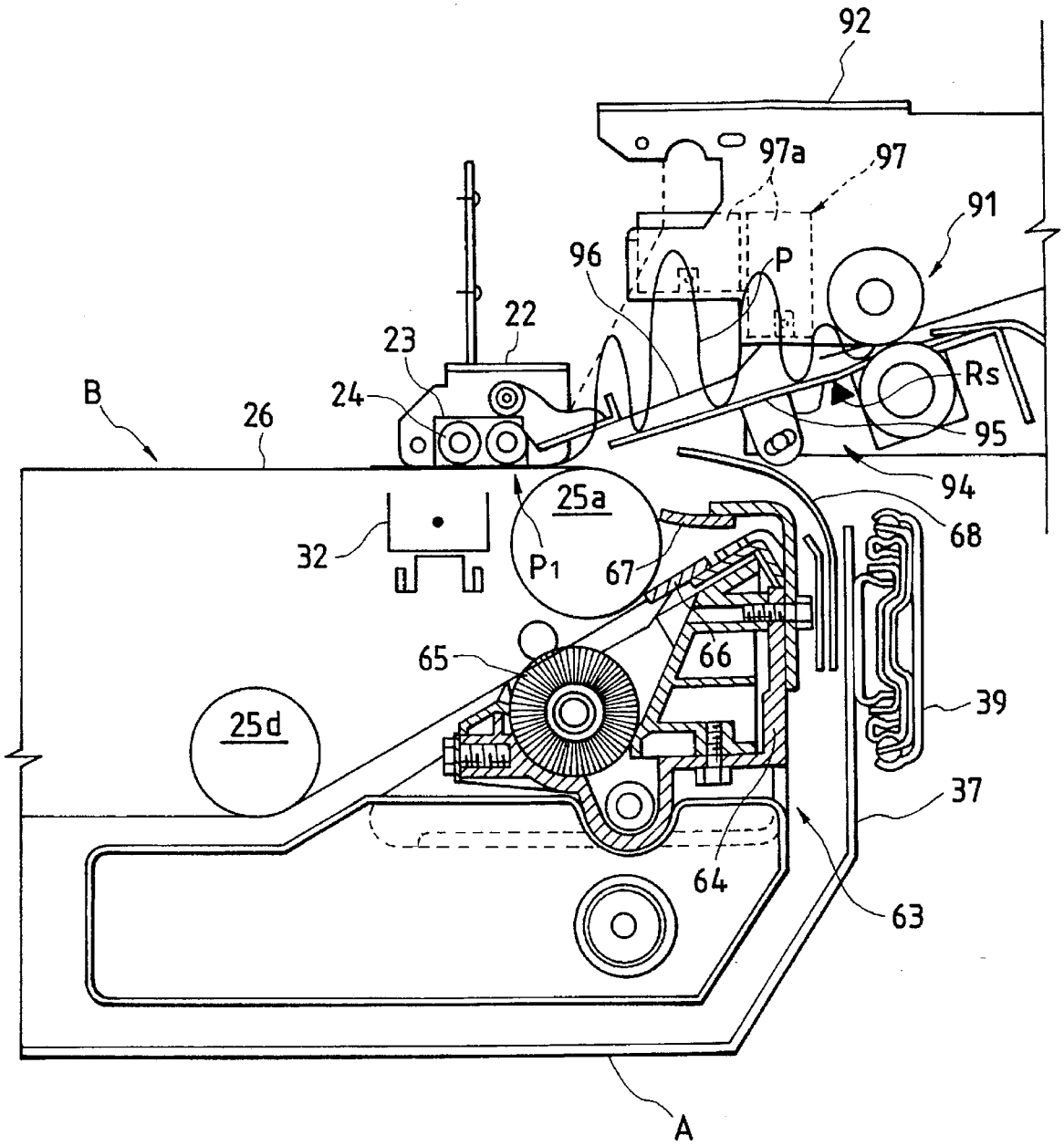
FIG. 9 is a cross sectional view similar to FIG. 8 showing the paper which is contained in the inlet chute while it is crinkled like an accordion.

FIG. 1 is a schematic representation of the overall image forming apparatus according to a first embodiment of the present invention. FIG. 2 is a perspective view of a belt module B of the image forming apparatus according to the first embodiment shown in FIG. 1. FIG. 3 is a perspective view of a removable member C made up of the belt module B and a movable table A which supports the belt module B according to the first embodiment shown in FIG. 1. FIG. 4 is a side cross sectional view of the removable member of the first embodiment which shows the movable table A after it has been moved to a predetermined position within the image forming apparatus. FIG. 5 is a schematic side view of the removable member shown in FIG. 4 when viewed in the direction designated by V. FIG. 6 is a schematic side view of the removable member which shows the belt module B raised from the removable member shown in FIG. 5. FIG. 7 is a plan view of the removable member C made up of the belt module B and the movable table A which shows the movable table A slightly drawn from a predetermined position (the position shown in FIG. 4) within the image forming apparatus. FIG. 8 is a cross sectional view of the principal element of the first embodiment, that is, a paper drawing-in unit of the belt module B, resi-rollers of a paper feed unit, and an inlet chute for guiding the paper fed from the resi-rollers. FIG. 9 is a cross sectional view similar to FIG. 8 showing the paper contained in the inlet chute while it is concertinaed.

In FIG. 1, a digital color copier U, that is, an image forming apparatus, is provided with a transparent platen glass 2 on which an original 1 is placed. An original illuminating unit 3 which scans across the original 1 while illuminating it is disposed below the platen glass 2. The original illuminating unit 3 is provided with a light source 4 for illuminating the original and a first mirror 5. A mirror unit 6 is disposed below the platen glass 2, and this mirror unit 6 travels at half the traveling speed of the original illuminating unit 3. The mirror unit 6 is provided with a second mirror 7 and a third mirror 8 for reflecting light from the original image which is originally emitted from the light source 4 and is reflected initially from the original and then from the first mirror 5 during the course of its travel.

The light reflected from the original image and, subsequently, from the third mirror 8 passes through an imaging lens 9 and is read by a color image read sensor 10 which converts the original image light into analog R, G, B signals.

The analog R, G, B signals converted by the color image read sensor 10 are further converted into digital image signals "y" (yellow), "m" (magenta), "c" (cyan), and "k" (black) by an image processing unit G. The thus converted digital signals are temporarily stored in memory of the image processing unit G.

The digital color copier U is provided with four toner image forming units Uy, Um, Uc, and Uk. The toner image forming units Uy, Um, Uc, and Uk form a yellow toner image (y), a magenta toner image (m), a cyan toner image (c), and a black toner image (k), respectively.

The toner image forming units Uy, Um, Uc, and Uk are respectively provided with image carriers Dy, Dm, Dc, and Dk. A laser scanning system 16, a developing unit 17, a cleaner 18, and an electrostatic charger 19 are disposed around each of the image carriers Dy, Dm, Dc, and Dk.

An angular reflecting member 21 which is bent at an angle of 90° is supported by the bottom of each cleaner 18 in such a way that its opening faces in a downward direction.

A fixed member 22 for supporting drawing-in rollers which is supported by the developing unit 17, and a movable member 23 for supporting drawing-in rollers which is supported by the fixed member 22 so as to be vertically movable within a predetermined distance, are disposed beside the yellow toner image carrier Dy in the −Y direction. The movable member 23 rotatively supports the drawing-in rollers 24. The drawing-in rollers 24 come into contact with a paper conveyor belt which will be described later by virtue of the weight of the drawing-in rollers 24 and the movable member 23. As a result, paper P is pressed against the paper conveyor belt and is drawn in by the belt.

A belt module B of the present invention will now be described.

The belt module B is disposed below the image carriers Dy, Dm, Dc, and Dk, and is supported by a movable table (a removable member) A shown in FIGS. 1 to 4.

In FIG. 2, the belt module B is provided with a plurality of belt supporting rollers 25*a*, 25*b*, 25*c*, and 25*d* rotatively supported between a front plate Pf and a rear plate Pr, and a transparent belt 2 supported by these rollers.

A pair of rods 27 are respectively provided on the front and rear plates Pf and Pr in such a way as to project to the outside. A front side guided member 28 (FIGS. 2 and 4) is provided along the upper edge of the front plate Pf. A hole to be positioned 28*a* is formed in this guided member 28.

In FIGS. 2 and 4, two brackets 29 are provided along the upper edge of the rear plate Pr so as to project to the outside. A rear side member to be guided 30 is provided on each of the brackets 29 so as to project upwards.

In FIG. 1, a light emitting/receiving member 31 is disposed below each reflecting member 21 so that the reflecting members and the light emitting/receiving members are respectively opposite to each other, with the transparent belt 26 between them. Each of the light emitting/receiving member 31 is provided with a light emitting element for emitting light to the reflecting member 21, and a light receiving element for receiving the light which is originally emitted from the light emitting element and then reflected from the reflecting member 21 while passing through the transparent belt 26 twice during the course of its travel. Each paper sensor S is made up of the reflecting member 21 and the corresponding light emitting/receiving member 31.

A drawing-in corotron 32 is disposed opposite to the drawing-in rollers 24 with the transparent belt 26 between them. Further, a transfer corotron 33 is disposed opposite to each of the image carriers Dy, Dm, Dc, and Dk.

The belt module B is made up of the above described elements 26 to 33. The image recording unit (B+Uy, Um, Uc, and Uk) is made up of the belt module B and the toner image forming units Uy, Um, Uc, and Uk.

In FIGS. 1, 3, 4, and 6, the movable table A that travels in the direction of the X axis while supporting the belt module B is provided with longitudinal side plates Qf and Qr and lateral side plates 36 and 37. The lateral side plates 36 and 37 of the movable table A are supported by a frame of the digital color copier U via movable rails 38 and 39 capable of sliding in the direction of the X axis. The movable rails of this type are commercially available.

The movable table A is provided with a pair of rollers 41 supported by the longitudinal front plate Qf. Further, the movable table A is provided with a pair of pins 42 supported by the rear-end longitudinal rear plate Pr (FIG. 7).

In FIG. 7, an operation shaft 43 which extends in the direction of the X axis is rotatively provided substantially at the center of the longitudinal front and rear plates Qf and Qr of the movable table A in the direction of the Y axis. Similarly, a pair of rotary shafts 44 and 45 for raising the movable table A are rotatively provided in the movable table A in parallel to the operation shaft 43.

The front end of the operation shaft 43 and the front ends of the rotary shafts 44 and 45 project forwards from the longitudinal front plate Qf. Pulleys 43*a*, 44*a*, and 45 are fixed to the respective front ends. A handle 43*c* is fixed to the front end of the operation shaft 43.

A rotatable idler pulley 46 is provided on the longitudinal front plate Qf between the pulleys 43*a* and 44*a*.

The rear end of the operation shaft 43 projects toward the rear of the longitudinal rear plate Qr, and a removal prevention clip 43*b* (FIG. 7) is attached to the rear end of the operation shaft 43.

Cams 44*b* and 45*b* are fixed to the rear ends of the rotary shafts 44 and 45 (FIGS. 4 and 7). The cams 44*b* and 45*b* are used for fixing the movable table A to a predetermined position of the main unit U1 of the image forming apparatus of the digital color copier U. These cams will be described later.

A wire 47 is wrapped around the pulleys 43*a*, 44*a*, 45*a*, and 46. When the handle 43*c* is rotated clockwise, the rotary shaft 44 rotates counterclockwise, whereas the rotary shaft 45 rotates clockwise.

With reference to FIGS. 3 to 7, a mechanism for raising and lowering the belt module B on the movable table A will be described.

Raising and lowering members 51 shown FIGS. 4 to 7 are designed so as to move up and down in conjunction with the rotations of the rotary shafts 44 and 45. The rods 27 of the belt module B are supported by the raising and lowering members 51, and therefore the belt module B moves up and down together with the raising and lowering actions of the raising and lowering members 51.

If the handle 43*c* in the state shown in FIG. 5 is rotated clockwise, the rotary shafts 44 and 45 rotate, and the raising and lowering members 51 move up. Associated with the upward movement of the raising and lowering members 51, the rods 27 supported by the raising and lowering members 51 also move up. As a result, the belt module B moves up and becomes positioned as shown in FIG. 6. In this state, the belt 26 of the belt module B is in contact with the image carriers Dy, Dm, Dc, and Dk.

If the handle 43*c* is rotated counterclockwise through 90° in the state shown in FIG. 6, the rotary shafts 44 and 45 rotate, and the raising and lowering members 51 move downwards. The rods 27 supported by the raising and lowering members 51 also move downwards, and hence the belt module B is lowered. As a result, the belt module B becomes positioned as shown in FIGS. 4 and 5.

In FIGS. 1 and 3, a stripper (a separating pawl) 61 is disposed on the movable table A downstream from the belt supporting roller 25*b*. Further, a fixing unit 62 is disposed downstream from the stripper 61. A belt cleaner 63 is disposed between the belt supporting rollers 25*a* and 25*d* in order to recover toner adhering to the surface of the belt 26.

As shown in FIGS. 8 and 9, the belt cleaner 63 is made up of a cleaner container 64, a rotary brush 65 supported by this cleaner container 64, a doctor blade 66, and a wiper blade 67.

On the assumption that the paper is drawn in by the belt 26 and the trailing end of the drawn in paper is positioned downstream from the belt supporting roller 25*a*, if the belt 26 is reversely rotated, the trailing end of the paper often moves in a rightward direction in FIG. 8. A guide 68 for receiving reversely fed paper is disposed beside the belt supporting roller 25 in a rightward direction in FIG. 8.

In FIG. 4, front positioning members 71 which project downwards are provided on a frame F of the main unit U1 of the image forming apparatus so as to correspond to the holes to be positioned 28*a* of the guided members 28 of the belt module B. These front positioning members 71 are provided on the frame which directly supports the image carriers Dy, Dm, Dc, and Dk. When the belt module B is raised, the positioning members 71 fit into the holes to be positioned 28*a*.

In FIG. 4, the frame F of the main unit U1 of the image forming apparatus has a guide member 72 which corresponds to a rear member to be guided 30 projecting upward from the upper edge of the rear plate Pr of the belt module B. The guide member 72 is directly provided on the frame which supports the image carriers Dy, Dm, Dc, and Dk, and a positioning hole 72*a* is formed in this guide member 72 so as to fit with the rear member to be guided 30 when the belt module B is raised.

As shown in FIG. 4, rotatable rollers 73 are provided on the frame F of the main unit U1 of the image forming apparatus so as to correspond to the pins 42 provided on the rear plate Qr of the movable table A. When the movable table A is inserted from the front side of the main unit U1 of the image forming apparatus toward the direction of the —X axis, the pins 42 sit astride and run on the rollers 73, whereby the rear end of the movable table 42 is vertically positioned.

While the movable table A is held in the position shown in FIG. 4, the pair of rollers 41 provided on the front side of the movable table A are supported by the rails 74 and 75 supported by the frame F of the main unit U1 of the digital color copier U. A slot is formed in the lower rail 75 so as to permit the movement of the movable table A in the X direction.

As shown in FIGS. 4 and 7, slots 76 are formed through the frame F of the main unit U1 of the image forming apparatus so as to correspond to the cams 44*b* and 45*b* provided on the rear ends of the rotary shafts 44 and 45. While the movable table A is inserted into the rear end of the main unit U1 of the image forming apparatus (as shown in FIG. 4), the cams 44*b* and 45*b* enter the cam through slots 76. If the rotary shafts 44 and 45 are rotated while the cams are inserted in the cam through slots 76, the cam surfaces of the cams 44*b* and 45*b* in the x direction come into contact with the rear surface of the frame F in which the cam through holes 76 are formed. As a result, the rotary shafts 44 and 45 are pulled backwards.

In other words, the movable table A is also pulled backwards together with the rotary shafts 44 and 45, whereby the movable table A is reliably positioned in the direction of the X axis.

If the movable table A is positioned in the direction of the Y axis as a result of the lateral plates 36 and 37 being guided by the movable rails 38 and 39, a paper raking member 81 is fixedly provided at the corner of the movable table A in the −X and −Y directions, as shown in FIGS. 5, 6, and 7. When the movable table A is pulled in the event of a paper jam occurring, the paper raking member 81 is moved to the outside, together with the movable table A, so as to rake out the jammed paper P.

The paper raking member 81 will now be described with reference to FIGS. 8 and 10 to 14. To prevent the drawing from being too complicated, the paper raking member 81 is omitted from FIG. 9.

Figure 10:
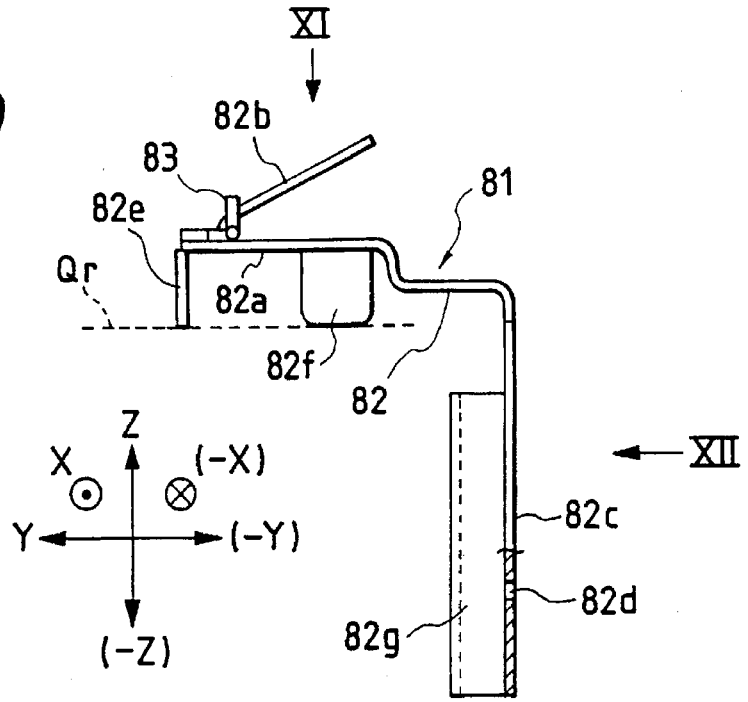
FIG. 10 is a front view of a paper raking member fixed at the right back of the movable table A for raking out paper contained in the inlet chute when the movable table A is pulled out.
Figure 11:
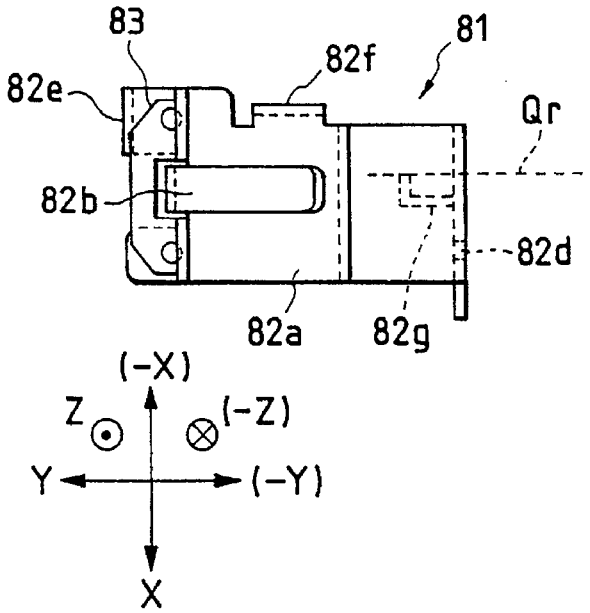
FIG. 11 is a top view of the paper raking member shown in FIG. 10.
Figure 12:
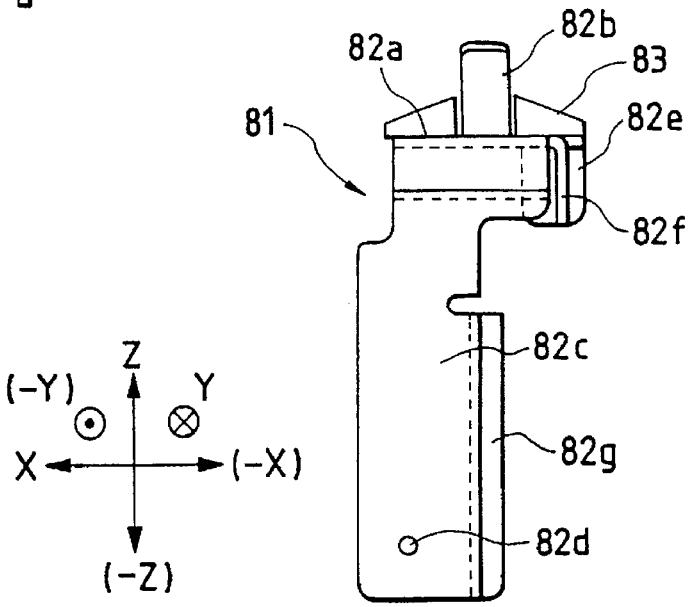
FIG. 12 is a side view of the paper raking member shown in FIG. 10 when viewed from the right.

FIG. 10 is a front view of a paper raking member fixed at the corner of the movable table A in the −X and −Y directions for raking paper contained in the inlet chute when the movable table A is pulled out. FIG. 11 is a top view of the paper raking member shown in FIG. 10. FIG. 12 is a side view of the paper raking member shown in FIG. 10 when viewed from the right.

Figure 13A:
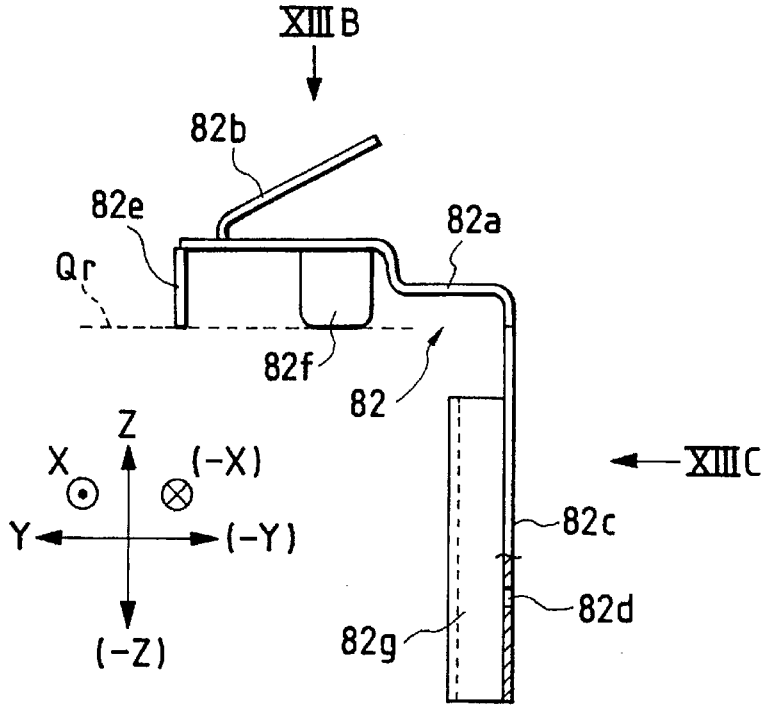
Figure 13B:
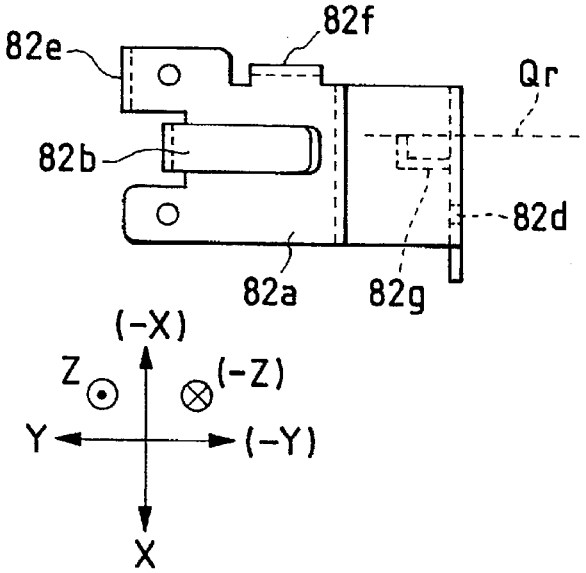
Figure 13C:
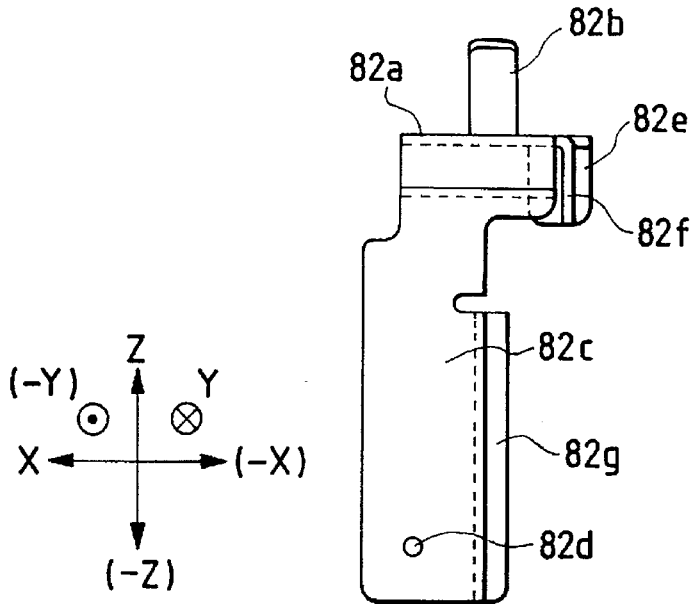

FIGS. 13A to 13C are schematic representations of the main body of the raking member, wherein FIG. 13A is a front view, FIG. 13B is a top view, and FIG. 13C is a right side view of the raking member.

Figure 14A:
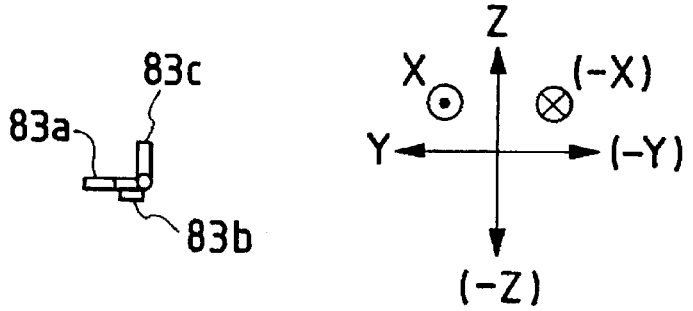
Figure 14B:
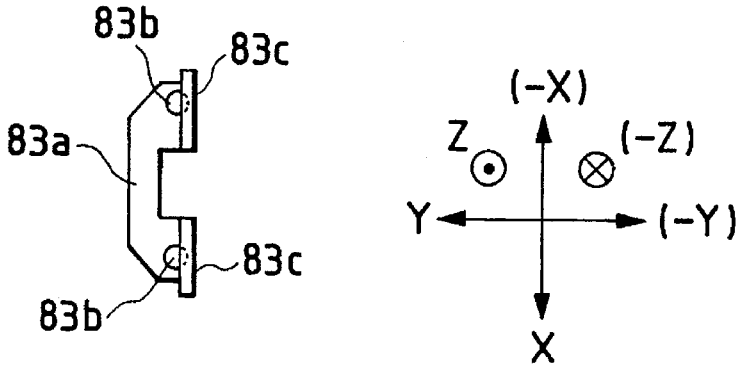
Figure 14C:
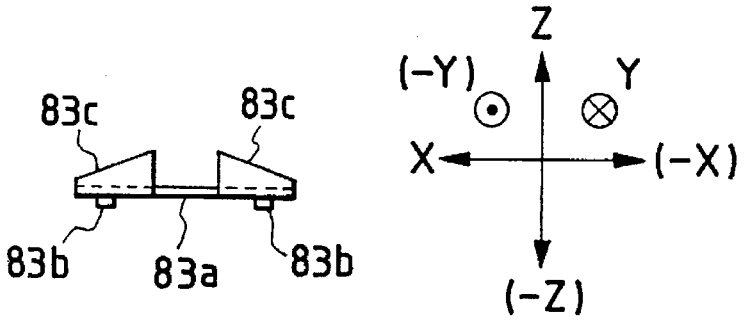

FIGS. 14A to 14C are schematic representations of a guide member attached to a top surface of the main body of the paper raking member, wherein FIG. 14A is a front view, FIG. 14B is a top view, and FIG. 14C is a right side view of the main body.

The paper raking member 81 shown in FIGS. 8 and 10 to 12 is made up of a metal main body 82 shown in FIG. 13 and a plastic guide member 83 shown in FIG. 14.

The main body 82 of the paper raking member 81 has a horizontal top plate 82*a*, a raking plate 82*b* that extends from the top plate 82*a* at an inclined angle in a rightward direction, and a vertical side plate 82*c*. A through hole 82*d* for a screw thread is formed in the side plate 82*c* so that the main body 82 can be screwed to the side plate 37 of the movable table A.

The top plate 82*e* is provided with downwardly folded portions 82*e* and 82*f*, and the lower ends of the folded portions 82*e* and 82*f* come into contact with the upper end of the longitudinal plate Qr. The side plate 82*c* has a folded portion 82*g* for positioning the rear end of the paper raking member 81, and this folded portion 82*g* is provided on a lower back portion of the side plate 82*c* as shown by a dotted line in FIG. 11. The leading end of the folded portion 82*g* comes into contact with the front surface of the longitudinal plate Qr, so that the paper raking member 81 is correctly positioned.

The plastic guide member 83 fixed on the top surface of the top plate 82*a* of the main body 82 of the raking member has a horizontal portion 83*a* and projections 83*b* for fixing purposes provided on a lower surface of the horizontal portion 83*a*. The projections 83*b* are provided to fix the guide member 83 to the main body 82 of the paper raking member.

A pair of guide members 83*c*, 83*c* are provided along the edge of the upper surface of the horizontal portion 83*a* of the guide member 83 in the −Y direction.

In FIG. 1, paper P is contained in each of paper cassettes 86, 87, and 88 disposed below the movable table A which supports the belt module B. The paper P is taken out of the cassette by means of paper drawing rollers 89, and the thus taken out paper is conveyed by resi-rollers (FIGS. 1, 8, and 9). The resi-rollers 91 are arranged so as to convey the paper P to a paper drawing-in position P1 between the belt 26 and the drawing-in rollers 24 at a predetermined timing (FIGS. 8 and 9).

The resi-rollers 91 are supported between a front supporting bracket 92 disposed at the front end (in the X direction) and a rear supporting bracket 93 disposed at the rear end (in the −X direction) in the direction of the X axis of the frame F of the main unit U1 of the image forming apparatus (only the front supporting bracket is shown in the drawings, with the rear supporting bracket being omitted from the drawings).

A resi-sensor Rs is disposed upstream with respect to the resi-rollers 91 for detecting the passage of the paper.

An inlet chute 94 is disposed for feeding the paper P from the resi-rollers 91 to a drawing-in position P1 at which the drawing-in rollers 24 and the belt 26 come into contact with each other. This inlet chute 94 is made up of a lower paper guide 95 and an upper paper guide 96. The lower paper guide 95 is fixedly supported between the supporting brackets 92 and 93. As shown in FIGS. 1, 8, and 9, the upper paper guide 96 is pivotally supported by the fixing member 22 for supporting the drawing-in rollers.

Therefore, if a paper jam arises while the paper P is being stretched between upstream and downstream sides of the resi-rollers 91, if the resi-rollers 91 are rotated to move the paper on the upstream side of the resi-rollers 91 to its downstream side while the belt 26 is stopped, the paper P will be concertinaed, as shown in FIG. 9. As a result, the upper paper guide 96 is raised by the crumpled paper.

Figure 15A:
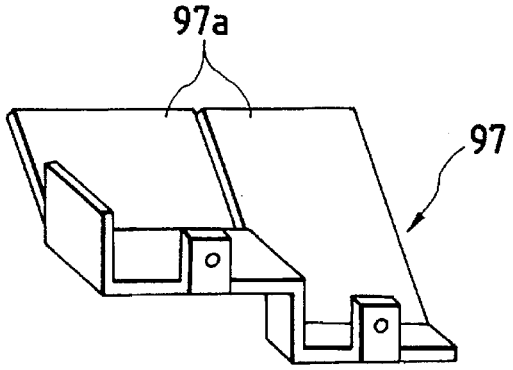
FIGS. 15A and 15B are schematic representations of a height regulating member 97 according to the first embodiment.
Figure 15B:
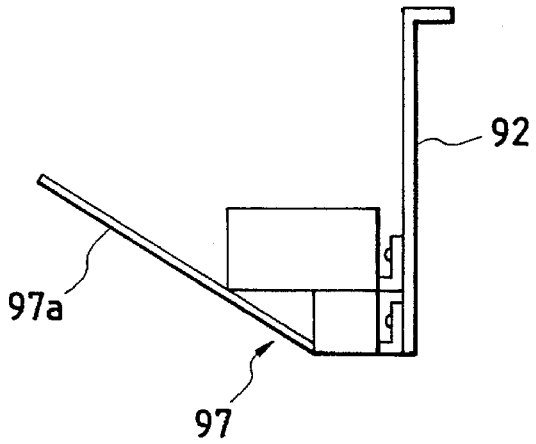

FIGS. 15A and 15B are schematic representations showing a height regulating member 97 according to a first embodiment 1.

The height regulating member 97 shown in FIGS. 15, 8, and 9 is attached to the rear surface of the front supporting bracket 92 shown in FIG. 9. The height regulating member 97 prevents the crumpled paper P (FIG. 9) that is to be raked out by the paper raking member 81 from being caught by the rear surface of the supporting bracket 92. The height regulating member 97 has a tapered guide 97*a* for guiding the crumpled paper P having a larger height toward the downward side of the supporting bracket 92.

As shown in FIG. 1, the frame F of the main unit U1 of the image forming apparatus, that is, the digital color copier, supports a separating corotron 98 disposed upstream with respect to the stripper 61.

Unfixed toner images of the respective color image carriers Dy, Dm, Dc, and Dk are transferred one by one to the paper P drawn in by the belt 26 at the paper drawing-in position P1. The paper is then separated from the belt by the stripper 61, and the thus separated paper is then subjected to fixing treatment by the fixing unit 62. The paper P having the toner images fixed thereon is conveyed to either a paper discharge tray 102 or a circulating path 103 by a switching action of a changeover gate 101.

The circulating path 103 also has an inverting path 104, and a changeover gate 106 is provided at a point where they branch. The paper which is to be subjected to a double-sided copying operation is once transferred to the inverting path 104 by the changeover gate 106. The paper is then switched back to, and transferred through, the circulating path 103.

Figure 16:
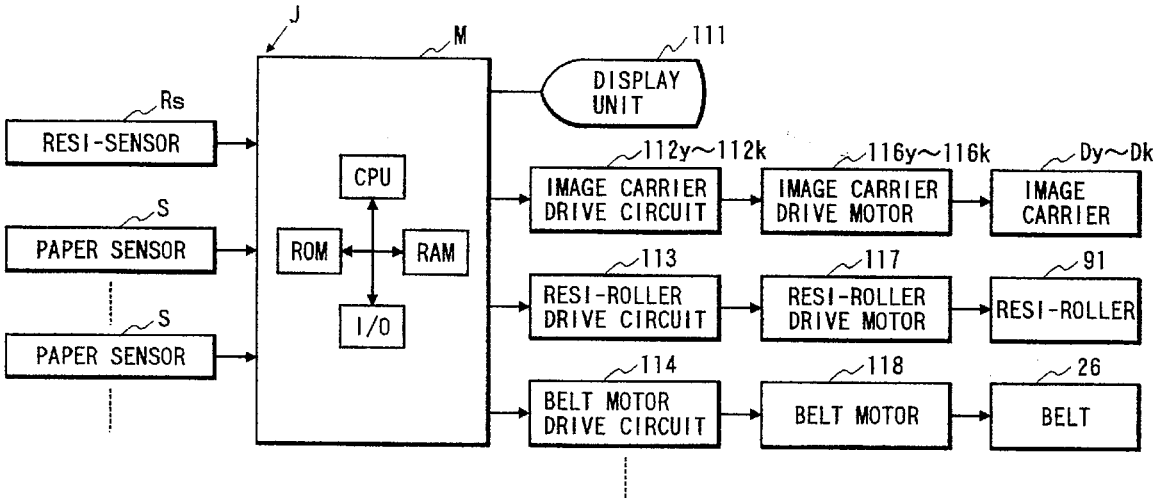
FIG. 16 is a block diagram showing the configuration of a control unit of the image forming apparatus according to the first embodiment.

FIG. 16 is a block diagram showing the configuration of a control section of the image forming apparatus according to the first embodiment.

FIG. 16 shows a control unit of the digital color copier (image forming apparatus) U of the first embodiment. The control unit shown in FIG. 16 uses a microcomputer M.

The microcomputer M is made up of an I/O (input/output interface) which controls the level of a signal input to or output from a connected unit, ROM (read only memory) which holds a control program of the digital color copier U, a CPU (central processing unit) which executes processing according to the program stored in the ROM, RAM (random access memory) used for temporarily storing data during the execution of the processing, a clock oscillator, and so forth.

The microcomputer M is connected to four paper sensors S (FIG. 1) respectively disposed along the belt 26 (the paper carrier) downstream with respect to the image carriers Dy, Dm, Dc, and Dk, the resi-sensor Rs, and other elements which output signals. The microcomputer M is connected to a display unit 111, image carrier drive circuits 112*y*, 112*m*, 112*c*, and 112*k*, a resi-roller drive circuit 113, a belt motor drive circuit 114, and other control elements. The microcomputer M is configured so as to process signals input from the paper sensors S and the resi-sensor Rs according to the program stored in the ROM, and to output an output signal, corresponding to a processing result, to the respective control elements 111 to 114.

The image carrier drive circuits 112*y*, 112*m*, 112*c*, and 112*k* drive image carrier drive motors 116*k*, 116*y*, 116*m*, and 116*c*. The resi-roller drive circuit 113 drives a resi-roller drive motor 117. The belt motor drive circuit 114 drives a belt motor 118.

The four paper sensors S, the resi-sensor Rs, and the microcomputer M constitute POP jam detecting means J.

Since an amount of light detected by the paper sensors S increases while the paper is passing between the light emitting/receiving member 31 and the reflecting member 21, it is possible to determine whether or not the paper is currently passing through. The ROM of the microcomputer M that is currently receiving a detection signal from each of the paper sensors S holds a program which makes a decision that a POP jam has occurred if the paper sensors fails to detect the paper at predetermined times after the passage of a given period of time from the time when the resi-rollers 91 started feeding the paper. In the first embodiment, the POP jam detecting means J is made up of the paper sensors S and the microcomputer M (not shown).

The microcomputer M and the resi-roller drive circuit 113 also constitute resi-roller control means (M+113). The resi-roller control means (M+113) has a function of transferring the paper P stretched between the upstream side and the downstream side of the resi-rollers 91 to the downstream side when the POP jam has been detected.

The microcomputer M and the belt motor drive circuit 114 in combination constitute reverse rotation suspending means (M+114) that reversely rotates the belt (paper carrier) 26 when the paper jam occurs, and stops the reverse rotation of the belt after having slightly rotated it in a forward direction.

The operation of the image forming apparatus having the above construction will now be described.

The belt module B is supported by the raising and lowering member 51 on the movable table A that is placed at a predetermined position below the image carriers in the direction of the Y axis and can be drawn from, and inserted into, the main unit of the image forming apparatus in the direction of the X axis. When the movable table A is inserted into or drawn out from the main unit U1 of the image forming apparatus, the belt module B is held in such a position as is shown in FIGS. 4 and 5 (a position spaced apart from the lower surfaces of the image carriers). At this time, the handle 43*c* remains fallen to the left (designated by a solid line in FIGS. 3 and 5).

As previously mentioned, the movable table A is inserted into the main unit U1 of the image forming apparatus while the belt module B on the movable table A is held at a lower position, as shown in FIG. 4.

At this time, tapers formed on top of the guide 83*c* of the paper raking member 81 (FIG. 7), and which are attached to the right back of the movable table A, enter between the lower paper guide 95 and the upper paper guide 96 shown in FIG. 8. The tapers of the guide 83*c* move in the rearward direction (in the −X direction) while raising the upper paper guide 96. A raking plate 82*b* of the paper raking member 81 enters between the lower paper guide 95 and the upper paper guide 96.

When the movable table A arrives at the rear position (the position shown in FIG. 4), the raking plate 82*b* passes the rear end of the upper paper guide 96, whereby the upper paper guide 96 is lowered to its original position.

When the handle 43*c* is rotated clockwise through 90° from the position designated by the solid line to the position designated by a two-dot chain line, the rotary shaft 44 rotates counterclockwise via the pulleys 43*a*, 44*a*, 45*a*, and 46 and the wire 47, whereas the rotary shaft 45 rotates clockwise. At this time, the raising and lowering member 51 is also raised. The belt module B supported by the raising and lowering member 51 is raised in association with the raising action of the raising and lowering member 51. As a result, the belt module B comes into contact with lower surfaces of the image carriers Dy, Dm, Dc, and Dk, as shown in FIG. 6.

As can be seen from FIG. 4, the hole to be positioned 28*a* fits with the front positioning member 71, whereas the rear member to be guided 30 fits into the positioning hole 72*a*, whereby the belt module is positioned where it will be used.

In this way, the belt module B is raised from the position shown in FIGS. 4 and 5, and it is set in the raised state shown in FIG. 6.

When an original is copied using the digital color copier U, it is possible to copy the original in the same manner as a normal digital color copier while the belt module B is retained in its upper position, as shown in FIG. 6.

The paper sensors S of the POP jam detecting means J (FIG. 16) are disposed along the belt 26 and slightly downward with respect the positions (transfer positions) of the respective transfer corotrons 33 (FIG. 1). During the copying operation, a light emitting element of the light emitting/receiving element 31 of the paper sensor S emits light, and the thus emitted light passes through the transparent conveyor belt 26. The light is then reflected from the reflecting member 21, and the thus reflected light enters a light receiving element of the light emitting/receiving element 31 after having passed once more through the transparent conveyor belt 26 again. The amount of light received by the light receiving element is detected.

When the paper is laid on the belt 26, the amount of light which enters the light receiving element after having passed through the surface of the transparent belt 26 is reduced, which makes it possible to detect the presence or absence of the paper P. Hence, the POP jam detecting means J detects the presence or absence of the paper P as a result of the amount of the light received by the paper sensor S at the predetermined time, and it is possible to detect the occurrence of the POP jam depending on the presence or absence of the paper P at that time.

When the paper sensors S detect the POP jam, the digital copier (image forming apparatus) U is stopped. The resi-rollers 91 of the paper feed unit which feed paper to the paper drawing-in position P1 are driven by the rotation control means (M+113) until the paper stretched between the resi-rollers 91 and the image recording unit passes the resi-rollers 91, and thereafter the resi-rollers 91 are stopped. The reverse rotation suspending means (M+114) reversely rotates the belt (paper carrier) 26 when the POP jam occurs, and stops the reverse rotation of the belt after having slightly rotated it in a forward direction.

The leading edge of the wiper blade 67 of the cleaner 63 (FIGS. 8 and 9) that cleans the belt 26 curls up when the belt 26 rotates in the reverse direction. The slight rotation of the belt 26 in a forward direction quickly corrects the curled up leading edge of the wiper blade 67, and the wiper blade comes into contact with the belt 26 while it is in a normal state. For this reason, it becomes possible to prolong the lift span of the wiper blade 67 to a much longer extent.

The movable table (removable member) A is drawn from the main unit of the image forming apparatus when jammed paper form the unit at the time of the occurrence of a POP jam. When the movable table A is drawn from the inside of the main unit of the image forming apparatus, the paper raking member 81 disposed on the movable table A rakes out the paper P contained in the inlet chute 94 disposed downstream from the resi-rollers 91.

When the POP jam arises, the paper stretched across the resi-rollers 91 of the paper feed unit and the image recording unit (B+Uy, Um, Uc, and Uk) can be easily removed by pulling the movable table A.

Figure 17:
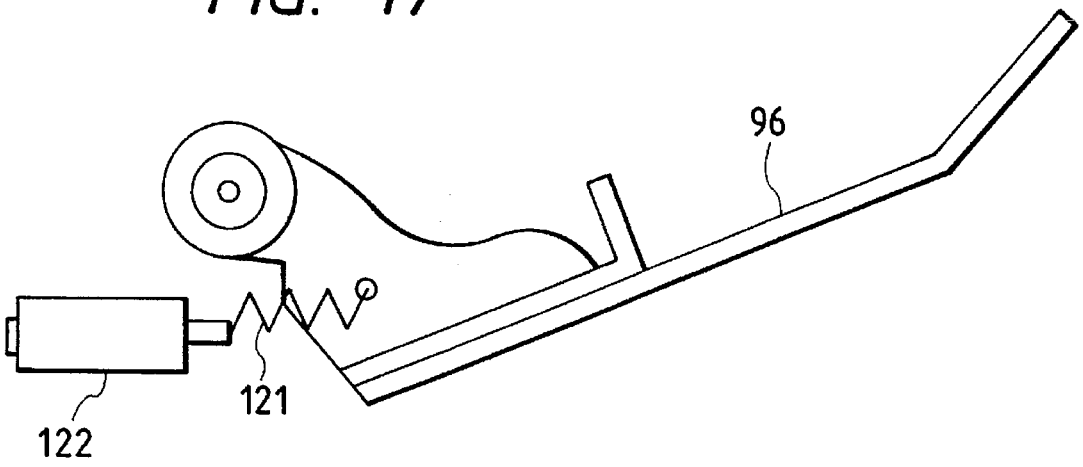
FIG. 17 is a schematic representation of an image forming apparatus according to a second embodiment which shows a difference between the second embodiment and the first embodiment.

With reference to FIG. 17, an image forming apparatus according to a second embodiment of the present invention will now be described. FIG. 17 shows a difference between the image forming apparatus of the first embodiment and the image forming apparatus of the second embodiment.

The same reference numerals are provided to designate the features corresponding to those of the first embodiment.

The second embodiment is the same as the first embodiment except for the following points:

Specifically, as shown in FIG. 17, the upper paper guide 96 of the first embodiment is connected to a solenoid 122 via a tension spring 121.

When the movable table A is pulled away from the main unit, the solenoid 122 is turned on. As a result, the paper P concertinaed, as shown in FIG. 9, is pressed, so that the height of the paper P is reduced. In other words, in the second embodiment, the tension spring 121 connected to the upper paper guide 96 and the solenoid 122 constitute a height regulating member that reduces the height of the crumpled paper P. Therefore, the height regulating member 97 employed in the first embodiment is omitted from the second embodiment.

As with the first embodiment, even in the second embodiment, it is possible to easily remove the paper stretched across the resi-rollers 91 of the paper feed unit and the image recording unit (B+Uy, Um, Uc, and Uk) when the POP jam arises, by pulling out the movable table A.

Although the preferred embodiments of the present invention have been described in detail, the present invention is not limited to the above illustrative embodiments. It is possible to contemplate various modifications of the present invention without departing from the spirit and scope of the present invention as claimed in the appended claims. Modifications of the present invention will be exemplified as follows:

The present invention is applicable to an image forming apparatus which permits the correction of a paper jam by means of a door, or by the movement of a movable unit instead of pulling away the movable table A.

The present invention, as it is exemplified in its first to fourth aspects, is also applicable to an opaque paper conveyor belt (paper carrier).

The present invention is also applicable to an image forming apparatus which employs a drum-like paper carrier instead of the belt-like paper carrier.

The present invention makes it is possible to easily remove all of the sheets of jammed paper by pulling a removable member (a drawer unit) out of the main unit of the image forming apparatus.

Provided that the image carriers and the paper carrier are reversely rotated when the POP jam arises, it is possible to reduce the time during which the leading edge of the wiper blade of the cleaner of the paper carrier is kept curled up. Hence, it is possible to prolong the life span of the wiper blade.

Detection of the light that has passed through the surface of a transparent belt (paper carrier) makes it possible to ensure the detection of the POP jam even in the case of the paper having images on both sides thereof obtained as a result of a double-sided copying operation.

What is claimed is:

1. An image forming apparatus comprising:

an image recording unit including, image carriers on which toner images are respectively formed, a paper carrier which conveys paper fed to a paper drawing-in position while drawing therein, and transfer units which transfer respective toner images on the image carriers onto the paper on the paper carrier at predetermined image transfer positions of said image carriers;

paper jam detecting means for detecting a paper jam occurring when the paper drawn in by said paper carrier adheres to the surfaces of said image carriers;

conveyor rollers disposed in a paper feeding unit which feeds the paper to a paper drawing-in position in said image recording unit at a predetermined timing;

an inlet chute including an upper paper guide and a lower paper guide for guiding the paper fed from said conveyor rollers toward the paper drawing-in position;

conveyor roller rotation control means which suspend the rotation of said conveyor rollers until the paper stretched between said image recording unit and said conveyor rollers of said paper feeding unit has passed through said conveyor rollers, if a paper jam arises while the paper is stretched therebetween;

reverse rotation suspending means which rotates said paper carrier in a reverse direction if a paper jam arises and then suspends the rotation; and a removable member configured so as to be detachable from, and attachable to, a main unit of said image forming apparatus.

2. The image forming apparatus of claim 1, further comprising:

a paper raking member disposed in said removable member for raking out the paper contained in said inlet chute disposed downstream with respect to said conveyor rollers when said removable member is removed from the inside of said main unit of said image forming apparatus.

3. The image forming apparatus of claim 2, further comprising a paper height regulating member which prevents the paper from being caught by constituent elements of the main unit of the image forming apparatus by regulating the height of the paper when the paper is raked out of said inlet chute.

4. The image forming apparatus of claim 1, further comprising:

a plurality of said image carriers on which toner images having different colors are respectively formed; and a fixing unit for fixing a toner image transferred on the paper, wherein said paper carrier includes a belt for conveying the paper which is rotatively supported by a plurality of rollers, said removable member includes said belt, said transfer unit, and said fixing unit; and said conveyor rollers and said inlet chute are supported by said main unit of said image forming apparatus.

5. The image forming apparatus of claim 4, further comprising a paper height regulating member which prevents the paper from being caught by constituent elements of the main unit of the image forming apparatus by regulating the height of the paper when the paper is raked out of said inlet chute.

6. The image forming apparatus of claim 1, wherein said upper paper guide of the inlet chute is supported by said main unit of said image forming apparatus via a developing unit of said image carrier disposed upstream in the direction in which the paper is conveyed by said belt.

7. The image forming apparatus of claim 6, further comprising a paper height regulating member which prevents the paper from being caught by constituent elements of the main unit of the image forming apparatus by regulating the height of the paper when the paper is raked out of said inlet chute.

8. The image forming apparatus of claim 1, further comprising a paper guide which is disposed in the removable member so as to be able to receive the paper conveyed in a reverse direction as a result of reversely rotating said paper carrier.

9. An image forming apparatus comprising:

an image recording unit including;

image carriers on which toner images are respectively formed, a paper carrier which conveys paper fed to a paper drawing-in position while drawing therein, and transfer units which transfer respective toner images on said image carriers to the paper on said paper carrier at predetermined transfer positions of said image carriers;

paper jam detecting means for detecting a paper jam occurring when the paper drawn in by said paper carrier adheres to the surfaces of said image carriers;

conveyor rollers disposed in a paper feeding unit for feeding the paper to a paper drawing-in position in said image recording unit at a predetermined timing;

an inlet chute including an upper paper guide and a lower paper guide for guiding the paper fed from said conveyor rollers toward the paper drawing-in position;

conveyor roller rotation control means which suspends the rotation of said conveyor rollers until the paper stretched between said image recording unit and said conveyor rollers of said paper feeding unit has passed through said conveyor rollers, if a paper jam arises while the paper is stretched between said image recording unit and said conveyor rollers;

reverse rotation suspending means which rotates said paper carrier in a reverse direction if a paper jam arises, and then suspends the rotation; and a cleaner having a wiper blade for cleaning said paper carrier.

10. An image forming apparatus comprising:

a image recording unit including;

image carriers on which toner images are respectively formed, a transparent paper carrier for conveying the paper fed to the paper drawing-in position while drawing the paper in, and a transfer unit which transfers the toner images on said image carriers to the paper on said paper carrier at predetermined transfer positions of said image carriers; and a paper jam detecting means disposed at a position slightly downstream with respect to the transfer position of said paper carrier, said paper jam detecting means detecting a paper jam using an amount of light received by a paper sensor designed to receive light reflected from the paper which enters said paper sensor after having traversed the surface of said paper carrier.

* * * * *